US005927939A

United States Patent [19]

Harada et al.

[11] Patent Number: 5,927,939

[45] Date of Patent: Jul. 27, 1999

[54] TURBOMACHINE HAVING VARIABLE ANGLE FLOW GUIDING DEVICE

[75] Inventors: Hideomi Harada, Fujisawa; Shunro Nishiwaki; Kazuo Takei, both of Yokohama, all of Japan

[73] Assignee: Ebara Corporation, Tokyo, Japan

[21] Appl. No.: 08/579,604

[22] Filed: Dec. 28, 1995

[30] Foreign Application Priority Data

| | | | |
|---|---|---|---|
| Dec. 28, 1994 | [JP] | Japan | 6-339169 |
| Dec. 28, 1994 | [JP] | Japan | 6-339170 |
| Sep. 8, 1995 | [JP] | Japan | 7-256716 |

[51] Int. Cl.[6] ..... F04D 27/02

[52] U.S. Cl. ..... 415/17; 415/15

[58] Field of Search ..... 415/15, 17, 26, 415/36, 42, 46, 47–49; 417/280

[56] References Cited

U.S. PATENT DOCUMENTS

| | | | |
|---|---|---|---|
| 3,963,369 | 6/1976 | Balje . | |
| 4,288,198 | 9/1981 | Hibino et al. | 415/17 |
| 4,503,684 | 3/1985 | Mount et al. . | |
| 4,616,483 | 10/1986 | Leonard | 415/47 |
| 4,642,026 | 2/1987 | Ruff . | |
| 5,618,160 | 4/1997 | Harada et al. | 415/17 |
| 5,683,223 | 11/1997 | Harada et al. | 415/17 |

FOREIGN PATENT DOCUMENTS

| | | | |
|---|---|---|---|
| 0 589 745 | 3/1994 | European Pat. Off. . | |
| 55-60695 | 5/1980 | Japan | 415/17 |
| 59-170491 | 9/1984 | Japan | 415/17 |
| 4-81598 | 3/1992 | Japan | 415/17 |

OTHER PUBLICATIONS

European Search Report and Abstract, Apr. 23, 1998; Appln. No. EP 95 12 0688.

Patent Abstracts of Japan, Pub. No. 04081598, Pub. Date Mar. 16, 1992, Diffuser Vane Position Controller for Compressor.

Patent Abstracts of Japan, Pub. No. 59170491, Pub. Date Sep. 26, 1984, Optimal Operation Control Method of Centrifugal Compressor.

Patent Abstracts of Japan, Pub. No. 61241498, Pub. Date Oct. 27, 1986, Flow Rate Control Method for Centrifugal Compressor by Variable Diffuser.

*Primary Examiner*—Christopher Verdier

*Attorney, Agent, or Firm*—Armstrong, Westerman, Hattori, McLeland, & Naughton

[57] ABSTRACT

A turbomachine having variable angle diffuser vanes is demonstrated with the use of a centrifugal pump. The performance of a diffuser is enhanced greatly by the use of adjustable angle diffuser vanes which can be set to a wide range of vane angles to provide a variable size of an opening between adjacent vanes. The demonstrated pumping system has a significantly wider operating range than that in conventional pumping systems over a wide flow rate, and is particularly effective in the low flow range in which known diffuser vane arrangements would lead to surge in the entire system and other serious operational problems. A number of examples and formulae are given to demonstrate the computational methods used to select a vane angle for a given set of operating conditions of the turbomachine.

12 Claims, 23 Drawing Sheets

TURBOMACHINE HAVING VARIABLE ANGLE FLOW GUIDING DEVICE

BACKGROUND OF THE INVENTION

1. Field of the Invention

The present invention relates in general to turbomachineries such as centrifugal and mixed flow pumps, gas blowers and compressors, and relates in particular to a turbomachinery having variable angle flow guiding device.

2. Description of the Related Art

Turbomachineries, generally referred to as pumps hereinbelow, are sometimes provided with diffusers for converting the dynamic energy of flowing fluid discharged from an impeller efficiently into a static pressure. The diffuser can be with or without vanes, but those with vanes are mostly designed simply to utilize the flow passages between the adjacent vanes as expanding flow passages.

A report entitled "Low-Solidity Cascade Diffuser" (Transaction of The Japan Society of Mechanical Engineers, Vol 45, No. 396, S54-8) described an improvement in pump performance when the pitch of the vanes is increased by making the vane cord length smaller than a value obtained by dividing the circumference length by the number of vanes. However, the vanes in this report are fixed vanes. Experiments in which vane angles are varied have been reported in "Experimental Results on a Rotatable Low Solidity Vaned Diffuser", ASME, paper 92-GT-19.

Furthermore, when the conventional centrifugal or mixed flow pump is operated at a flow rate much less than a design flow rate, flow separation occur at the impeller, diffuser and other locations in the operating system, causing a drop in the pressure rise to a value below the maximum pressure of the pump to lead to instability in the pump system (such a phenomenon as termed surge) eventually disabling a stable operation of the pumping system.

The instability phenomenon is examined in more detail in the following.

The velocity vectors of the flow discharged from the impeller can be divided into radial components and peripheral velocity components as illustrated in FIG. 1. Assuming that there is no loss in the diffuser and that the fluid is incompressible, then the quantity $r_2 v\theta_2$, which is a product of the radius at the diffuser entrance $r_2$ and the peripheral velocity components $V\theta_2$, is maintained to the diffuser exit according to the law of conservation of angular momentum, therefore, the peripheral velocity components $V\theta_3$ is given by:

$$V\theta_3 = V\theta_2 \cdot (r_2/r_3).$$

where $r_3$ is the radius at the diffuser exit. It can be seen that the velocity is reduced by the ratio of the inlet and exit radii of a diffuser.

On the other hand, the area $A_2$ of the diffuser inlet is given by:

$$A_2 = 2\pi b_2 r_2$$

where b is the width of the diffuser.

Similarly, the area $A_3$ of the diffuser exit is given by:

$$A_3 = 2\pi b_3 r_3$$

If the diffuser is a parallel-wall vaneless type diffuser, then the ratio of the areas $A_2/A_3$ is the same as the ratio of the radii $r_2/r_3$. Assuming that there is no loss within the diffuser and that the fluid is incompressible, the radial velocity $V_{r3}$ at the diffuser exit is given by the law of conservation of mass flow as follows.

$$V_{r3} = V_{r2} \cdot (r_2/r_3)$$

It follows that the radial velocity component is also reduced by the ratio of the inlet/exit radii of the diffuser, and the inlet flow angle $\alpha_2$ becomes equal to the exit flow angle $\alpha_3$, and the flow pattern becomes an logarithmic spiral flow.

Assuming that the slip effect of the flow inside the impeller is approximately constant regardless of the flow rate, when the flow rate is progressively lowered, although the velocity component in the peripheral direction hardly changes, the radial velocity component decreases nearly proportionally to the flow rate, and the flow angle decreases.

When the flow rate is lowered even further, the flow which maintained the radial velocity component at the diffuser inlet also decreases due to the diffuser area expansion, and the radial velocity component at the diffuser exit becomes low in accordance with the law of conservation of mass flow.

Further consideration is that a boundary layer exists at the diffuser wall surface, in which both the flow velocity and the energy values are lower than those in the main flow, therefore, even if the radial velocity component is positive at the main flow, flow separation can occur within the boundary layer, and a negative velocity component is generated, and eventually develops into a large-scale reverse flow.

It is becoming clear through various investigations that the reverse flow region becomes a propagating stall accompanied by cyclic fluctuation in flow velocity and acts as a trigger to generate a large scale surge phenomenon in the entire operating system.

In the conventional pumps having a fixed diffuser, it is not possible to prevent flow separation within the boundary layer or the reverse flow caused by low flow rate through the pump. To improve on such conditions, there are several known techniques based on variable diffuser width disclosed in, for example, a U.S. Pat. No. 4,378,194; U.S. Pat. No. 3,426,964; Japanese Laid-open Patent Publication No. S58-594; and Japanese Laid-open Patent Publication No. S58-12240. In other techniques, diffuser vane angles can be varied as disclosed in, for example, Japanese Laid-open Patent Publication No. S53-113308; Japanese Laid-open Patent Publication No. S54-119111; Japanese Laid-open Patent Publication No. S54-133611; Japanese Laid-open Patent Publication No. S55-123399; Japanese Laid-open Patent Publication No. S55-125400; Japanese Laid-open Patent Publication No. S57-56699; and Japanese Laid-open Patent Publication No. H3-37397.

Although the method based on decreasing the diffuser width improve the above mentioned problem, the frictional loss at the diffuser wall increases, causing the efficiency of the diffuser to be greatly diminished. Therefore, this type of approach presents a problem that it is applicable only to a narrow range of flow rates.

Another approach based on variable angle diffuser vanes presents a problem that because the diffuser vanes are long, the diffuser vanes touch each other at some finite angle, and therefore, it is not possible to control the flow rate down to the shut-off flow rate.

The other approach disclosed in U.S. Pat. No. 3,957,392 is based on divided diffuser vanes where only an upstream portion thereof is movable, however, it is not possible to control the flow rate down to the shut-off flow rate.

Another problem presented by the variable angle diffuser vanes is that because the purpose is to optimize the performance near some design flow rate, it is not possible to control the pumping operation at or below a flow rate to cause surge. Furthermore, none of these references discloses a clear method of determining the diffuser vane angle, and therefore, they have not contributed to solving the problems of surge in a practical and useful way.

For example, a method of determining the diffuser vane angle has been discussed in a Japanese Laid-open Patent Publication No. H4-81598, but this reference also discloses only a conceptual guide to determining the vane angle near a design flow rate, and there is no clear disclosure related to a concrete method of determining a suitable vane angle for flow rates to the shut-off flow rate.

There are other methods known to prevent instability, for example, based on providing a separate bypass pipe (blow-off for blowers and compressors) so that when a low flow rate to the pump threatens instability in the operation of the pump, a bypass pipe can be opened to maintain the flow to the pump for maintaining the stable operation and reduce the flow to the equipment.

However, according to this method, it is necessary beforehand to estimate the flow rate to cause an instability in the operation of the pump, and to take a step to open a valve for the bypass pipe when this flow rate is reached. Therefore, according to this method, the entire fluid system cannot be controlled accurately unless the flow rate to cause the instability is accurately known. Also, it is necessary to know the operating characteristics of the turbomachinery correctly at various rotational speeds of the p in order to properly control the entire fluid system. Therefore, if the operation involves continuous changes in rotational speed of the pump, such a control technique is unable to keep up with the changing conditions of the pump operation.

Furthermore, even if the instability point is avoided by activating the valve on the bypass pipe, the operating conditions of the pump itself does not change, and the pump operates ineffectively, and it presents a wasteful energy consumption. Further, this type of approach requires installation of bypass pipes and valves, and the cost of the system becomes high.

SUMMARY OF THE INVENTION

It is an object of the present invention to provide a turbomachinery having adjustable angle diffuser vanes to enable operation over a wide range of flow rates while avoiding generation of instability, particularly when the turbomachinery is operated at a very low flow rate, which would have caused instability in the past, to lead to an inoperative pumping system.

The object has been achieved in a basic form of the turbomachinery comprising: flow detection means for determining an inlet flow rate into the turbomachinery; and control means for controlling an angle of the diffuser vanes on a basis of the inlet flow rate and the vane angle in accordance with an equation:

$$\alpha = arctan\ (Q/(K_1N - K_2Q)) \quad (1)$$

where $\alpha$ is an angle of the diffuser vanes; Q is an inlet flow rate; N is rotational speed of an impeller; and $K_1$ and $K_2$ are constants respectively given by:

$$K_1 = (\pi D_2)^2 \sigma b_2 B$$

$$K_2 = \cot\beta_2$$

where $D_2$ is the exit diameter of the impeller; $\sigma$ is a slip factor; $b_2$ is an exit width of the impeller, B is a blockage factor; and $\beta_2$ is a blade exit angle of the impeller measured from tangential direction.

If the pump is a variable speed pump where the rotational speed N is allowed to change, it is possible to provide a rotational speed sensor to measure this quantity to control the vane angle.

Another aspect of the basic turbomachinery comprises: detection means for determining an inlet flow rate; detection means for determining a pressure ratio of an inlet pressure to an exit pressure of the turbomachinery; and control means for controlling an angle of the diffuser vanes on a basis of the inlet flow rate, and the pressure ratio determined by the detection means in accordance with an equation:

$$\alpha = arctan[(1/P_r)^{1/\kappa} Q/\{K_1N - (1/P_r)^{1/\kappa} K_2Q\}] \quad (2)$$

where $\alpha$ is an angle of the diffuser vanes; Q is a flow rate; $P_r$ is a pressure ratio at inlet and exit locations of the turbomachinery; N is the rotational speed of an impeller; K is a ratio of the specific heat of a fluid; and $K_1$ and $K_2$ are constants respectively expressed as:

$$K_1 = (\pi D_2)^2 \sigma b_2 B \text{ an}$$

$$K_2 = \mathrm{Cot}\beta_2$$

where $\sigma$ is a slip factor; $\beta 2$ is a blade exit angle of the impeller measured from tangential direction, $D_2$ is the exit diameter of the impeller, $b_2$ is an exit width of the impeller, and B is a blockage factor.

An aspect of the turbomachinery above is that if the rotational speed is allowed to change, a rotational speed sensor is provided to measure this quantity to control the vane angle based on the rotational speed.

By such a configuration of the turbomachinery, it is also permissible to control the turbomachinery from a maximum flow rate to the shut-off flow rate.

Theoretical Description

The conceptual framework of the inventions disclosed above is derived from the following theoretical considerations. Referring to FIG. 2, the directions of exiting flow from the impeller 2 are given as a (design flow rate); b (low flow rate); and c (high flow rate). As seen clearly in this illustration, at flow rates other than the design flow rate, there is misdirecting in the flow with respect to the angle of the diffuser vane. At the high flow rate c, the inlet angle of the flow is directed to the pressure side of the diffuser vane 3*a* of the diffuser 3; and at the low flow rate, it is directed to the suction side of the diffuser vane 3*a*. This condition produces flow separation at both higher and lower flow rates than the design flow rate, thus leading to the condition shown in FIG. 3 such that the diffuser loss increases. As a result, the overall performance of the compressor system is that, as shown in FIG. 4 (shown by the correlation between the non-dimensional flow rate and non-dimensional head coefficient), below the design flow rate, not only an instability is introduced as shown by a positive slope of the head curve at low flow rates, but surge also appears in the piping, leading to a large variation in the internal volume and eventually to inoperation of the pump.

This problem can be resolved by making the vane angle of the diffuser adjust the flow angle of the exiting flow from the impeller. A method is discussed in the following.

An exit flow from the impeller is denoted by $Q_2$, the impeller diameter by $D_2$, the exit width of the impeller by $b_2$, and the blockage factor at the impeller exit by B. The radial velocity component $Cm_2$ at the impeller exit is given by:

$$Cm_2 = Q_2/(\pi D_2 b_2 B) \quad (3)$$

Assuming that the fluid is incompressible, $Q_2$ is equal to the inlet flow rate Q, therefore, $$Cm_2=Q/(\pi D_2 b_2 B) \quad (4)$$

Here, when a fluid is flowing in a diffuser, the flow velocity near the wall surface is lower than that in the main flow. Denoting the main flow velocity by U, the velocity in the boundary layer by u, then the deficient flow rate caused by the slower boundary velocity compared with the main velocity is given by:

$$\int_0^\infty (U-u)\,dy$$

where y is the normal distance from the wall. If a flow having the same velocity as the main flow flows in a displacement thickness $\delta^*$, then the flow rate is given by $U\delta^*$. Because the two are equal, the displacement thickness is given by:

$$\delta^* = (1/U)\int_0^\infty (U-u)\,dy$$

(Refer to "Fluid Dynamics 2" by Corona or "Internal Flow Dynamics" by Yokendo).

In general, the average flow velocity is calculated by considering the narrowing of the width of the flow passage due to the effect of the displacement thickness. However, in turbomachineries, the fluid flow exiting from an impeller is not uniform in the width direction of the passage (refer, for example, to the Transaction of Japan Society of Mechanical Engineers, v.44, No.384, FIG. 20). In the region of flow velocity slower than the main flow velocity, displacement thickness becomes even thicker than the boundary layer. It follows that, it is necessary to correct geometrical width of a flow passage for the effects of the boundary layer and a distortion in the velocity distribution, otherwise the calculated velocity in the flow passage tends to be underestimated and the flow angles thus calculated are also subject to large errors. In the present invention, therefore, correction of the width of the flow passage is made by considering a parameter termed a blockage factor.

It is already disclosed in references such as those cited above that the effect of the blockage factor is not uniform with flow rate. Therefore, unless some understanding is achieved on how the blockage factor varies with flow rate, it is not possible to determine the flow angle at the impeller exit. For this reason, in the present invention, the blockage factor was reversely analyzed from experimental results in which various sensors were attached to the turbomachinery or to supplementary piping to measure some physical parameters such as pressure, temperature, vibration or noise, to obtain an empirical correlation between the flow rate and the angle of the diffuser vanes so as to find the vane angle at which the system exhibit least vibration. This data together with the equations established in the present invention were used to reversely compute the blockage factor. According to this methodology, if the equations are correct, there should be found a physically meaningful correlation between the blockage factor and the flow rate.

FIG. 5 shows the study results obtained in the present invention. For consistency with the above cited reference, (1-B) was plotted on the y-axis and a non-dimensional flow coefficient (a ratio of a flow rate to a design flow rate) on the x-axis, where B is the blockage factor. The results showed that the correlation obtained by using the correlation in the present invention was different than that disclosed in above-noted references, and showed that the blockage factor varies almost linearly with the flow rate.

The slope of the line depends on the type of impellers, but it is considered that the overall tendency would be the same. Thus, if such a linear relation is established for each type of turbomachinery, the blockage factor can be obtained from such a graph for any particular turbomachinery, and using the computed blockage factor together with the inlet flow rate, it is possible to accurately determine the flow angle at the impeller exit.

Therefore, an aspect of the present invention is based on the methodology discussed above, so that the blockage factor is a function of the flow rate, and it may vary linearly with the flow rate.

Turning to the other flow velocity component, namely the peripheral velocity component $Cu_2$ is given by:

$$Cu_2=\sigma U_2=Cm_2\cot\beta_2 \quad (5)$$

where $\sigma$ is the slip factor and $\beta 2$ is the blade exit angle of the impeller measured from tangential direction and $U_2$ is the peripheral speed. It follows that the flow angle from the impeller exit, which should coincide with the angle $\alpha$ of the diffuser vanes for optimum performance, is given by:

$$\alpha = \arctan(Cm_2/Cu_2) \quad (6)$$
$$= \arctan(Q/(\pi\sigma D_2 U_2 b_2 B - Q\cot\beta_2))$$

Let a pair of constants be $K_1=(\pi D_2)^2\sigma b_2 B$, $K_2=\cot\beta_2$ (7)

and designating the rotational speed by N, equation (6) can be rewritten as:

$$\alpha=arctan(Q/(K_1N-K_2Q)) \quad (8)$$

In the meantime, if the fluid is compressible, the impeller exit flow rate $Q_2$ is simply given by:

$$Q_2=(1/P_r)^{1/\kappa}Q \quad (9)$$

where $P_r$ is a ratio of the inlet/exit pressures of the turbomachinery and $\kappa$ is a specific heat ratio of the fluid. Therefore, it follows that:

$$Cm_2=(1/P_r)^{1/\kappa}Q/(\pi D_2 b_2 B) \quad (10)$$

Combining equations (5) and (10), the flow angle from the impeller, i.e. angle of the diffuser vanes, is given by:

$$\alpha = \arctan(Cm_2/Cu_2) \quad (11)$$
$$= \arctan((1/P_r)^{1/\kappa}Q/(K_1N-(1/P_r)^{1/\kappa}K_2Q))$$

Therefore, it can be seen that, for an incompressible fluid, the angle of the diffuser vanes can be obtained by knowing the inlet flow rate and rotational speed; for a compressible fluid, the same can be obtained by knowing the inlet flow rate, rotational speed and a ratio of the inlet/exit pressures at the turbomachinery. These variables can be measured by sensors, and the detection device can be used to compute the flow angle to which the vane angle is adjusted, thereby preventing flow separation in the diffuser and surge in the pumping system. Since the methodology of computing of vane angles with the use of generalized operating parameters and variables associated with the turbomachinery is independent of the type or size of the system, it can be applied to any type of conventional or new turbomachineries having adjustable diffuser vanes. Therefore, it is possible to input correlation of flow rate and suitable vane angles in a control unit in advance without performing individual tests to determine the operating characteristics of each machine.

Another aspect of the present invention is a turbomachinery comprising: detection means for determining an inlet flow rate of the turbomachinery; and control means for controlling a size of an opening formed by adjacent diffuser vanes in accordance with the inlet flow rate and a predetermined relation between the inlet flow rate and the size of an opening.

The conceptual framework of the invention is derived from the following theoretical considerations.

When the diffuser vanes are oriented at an angle, the adjacent vanes form an opening which acts as a flow passage. The size of this opening is denoted by A. If the absolute velocity of the fluid exiting the impeller is denoted by C, then the flow velocity passing through the opening is given by $K_3C$ where $K_3$ is the deceleration factor of the velocity in traveling a distance from the impeller to the diffuser vanes. Denoting the radial velocity component by $Cm_2$ and the peripheral velocity component by $Cu_2$ from the impeller exit, C is given by:

$$C=(Cm_2^2+Cu_2^2)^{1/2} \tag{12}$$

The flow rate $Q_2$ of the fluid passing through the opening is given by:

$$Q_2=K_3CA \tag{13}$$

The peripheral velocity component is given by equation (5) as:

$$Cu_2=\sigma U_2-Cm_2\cot\beta_2 \tag{14}$$

Therefore, $Q_2$ becomes:

$$\begin{aligned} Q_2 &= K_3[Cm_2^2+(\sigma U_2-Cm_2\cot\beta_2)^2]^{1/2}A \\ &= K_3A[(\sigma U_2)^2-2\sigma U_2Cm_2\cot\beta_2+(1+\cot^2\beta_2)Cm_2^2]^{1/2} \end{aligned} \tag{15}$$

In the meantime, from equation (3), $Q_2$ is given by:

$$Q_2=\pi D_2b_2B\cdot Cm_2 \tag{16}$$

and the radial velocity component $Cm_2$ at the impeller exit is given by:

$$Cm_2=Q/\pi D_2b_2B \tag{17}$$

therefore, $$Q_2=K_3A[(\pi D_2b_2B\sigma U_2)^2-2(\pi D_2b_2B)\sigma U_2Q_2\cot\beta_2+(1+\cot^{2\beta}{}_2)Q_2^2/(\pi D_2b_2B)]^{1/2} \tag{18}$$

replacing the terms with:

$$K_4=\pi D_2b_2B \tag{19}$$

$$K_5=(K_4\sigma\pi D_2)^2 \tag{20}$$

$$K_6=2K_4\sigma\pi D_2\cot\beta_2 \tag{21}$$

$$K_7=1+\cot^2\beta_2 \tag{22}$$

and assuming an incompressible fluid, and denoting the inlet flow rate by Q, rotational speed by N, then the size of the opening A is given by:

$$A=K_4Q/(K_3(K_5N^2-K_6NQ+K_7Q^2)^{1/2}) \tag{23}$$

For a compressible fluid, the exit flow rate from the impeller is given by:

$$Q_2=(1/P_r)^{1/\kappa}Q \tag{24}$$

where $P_r$ is a ratio of the inlet/exit pressures, and $\kappa$ is the specific heat ratio.

These equations were used to obtain the experimental values of the opening size between the adjacent vanes, using the pump facility showing in FIG. 6. The experimental values of the opening size were compared with results shown in FIGS. 12 to 24 (explained in detail in the embodiments) to obtain the results shown in FIG. 17 which shows an effect of the size of the opening on the flow rate.

In another aspect of the present invention, the turbomachinery is operated in accordance with the operating parameters, determined in the equations presented above, to orient the vanes at a suitable vane angle to avoid an onset of instability. In a turbomachinery having a variable speed impeller, when the head value is not adequate even after adjusting the angle of the vanes, then the rotational speed can be changed with avoiding an onset of instability.

In another aspect of the present invention, the turbomachinery can be operated while controlling both the vane angle and the size of the opening simultaneously to avoid instability.

The turbomachinery may be operated while exercising a control over a range of maximum flow rate to the minimum flow rate.

The above series of turbomachineries are based on direct detection of the inlet flow rate, but it is simpler, in some cases, even more accurate to rely on an indirect parameter to determine the angle of the diffuser vanes.

In another aspect of the present invention, the turbomachinery is based on this concept, wherein a detection device is provided to detect an operating parameter (or a driver for the turbomachinery) which closely reflects the changes of inlet flow rate.

Such an operating parameter can be any of, for example, an input current to the pump driver, rotational speed of the impeller, inlet pressure, flow velocity in piping, flow temperature difference at inlet/exit locations of the impeller, noise intensity at a certain location of the turbomachinery or piping, and valve opening. When the turbomachinery is cooled by a gas cooler, the amount of heat exchange can also be a parameter.

Some of the critical structural configurations include the setting of the angle of the diffuser vanes when the flow is substantially zero. Under these conditions, it is necessary to close the vanes so that the size of the opening is also substantially zero. The minimum length of a vane is given by dividing the circumferential length at the diffuser attachment location by the number of vanes provided.

Another aspect of the invention is, therefore, the arrangement that the diffuser vane length is at or slightly longer than such minimum length so that the leading edge of a vane overlaps the trailing edge of an adjacent vane. According to such a construct, even when there is no substantial flow from the impeller into the diffuser, the vane angle can be adjusted to substantially zero to avoid the generation of instability, thereby enabling the turbomachinery to provide a stable performance over a wide range of flow rates. However, a fully-closed condition of the vanes should be avoided because it may lead to a temperature rise in the overall system.

In another aspect of the present invention, the pivoting points of the vanes are arranged along a circumference at a radius given by 1.08 to 1.65 times the impeller radius so as to prevent the edge of the vane touching the impeller when the vanes are fully opened to a vane angle of 90 degrees.

This is illustrated in FIG. 12, and the requirements for the vane of total length L and the leading edge of the vane to the pivoting point is $L_1$, to meet the condition set forth above is given by a line passing through a point ($x_1$, $y_1$) where:

$$x_1=-(r_v+t)\sin(2\pi/z)$$

$$y_1=(r_v+t)\cos(2x/z)$$

and z is the number of vanes. $L_1$ is calculated as follows. In FIG. 12, a straight line "a" having a gradient tan(2π/z) and passing through a point ($x_1$, $y_1$) at a radius ($r_v$+t) intersects with a line "b" ($y=r_v-t$) at a point (x, y). Therefore, $$x=1/[\tan(2\pi/z)][(r_v-t)-\{(r_v+t)/\cos(2\pi/z)\}]$$

$$y=\tan(2\pi/z)x+(r_v+t)/\cos(2\pi/z)$$

and the length for $L_1$ is given by:

$$L_1=[(x-x_1)^2+(y-y_1)^2]^{1/2}$$

The condition for the vane edge to not touch the periphery of the impeller at radius $r_2$, when the vane angle is set to 90 degrees (again referring to FIG. 12) is given by:

$$r_v-L_1>r_2$$

$$r_v>r_2+L_1=(r_2+2\pi r_v/z)\ (0.2 \text{ to } 0.5)$$

$$r_v(1-2\pi(0.2 \text{ to } 0.5)/z))>r_2$$

$$\text{i } r_v>r_2/(1-(2\pi(0.2 \text{ to } 0.5))/z)$$

It follows that $r_v$ is 1.08 to 1.65 when z is in a range between 8 to 18.

Another feature of the diffuser vanes is that the distance between the leading edge of a vane and the pivoting point is between 20 to 50% of the total length of the vane.

This feature is required because the rotational torque required to rotate the vane during an operation about the vane shaft must be larger than a pressure torque generated by the pressure differential between the suction side and the pressure side of the vanes 3*a* as shown in FIG. 2. When the pressure acting at the leading edge of the vanes is about equal to that acting at the trailing edge of the vanes, the pivoting shaft should be placed in the middle of a vane to minimize the rotational torque necessary. However, when the vanes are rotated about the vane shaft, the pressure at the leading edge is always slightly higher than that at the trailing edge, therefore, the pivoting shaft should be placed at 20–50%, and more preferably 30–50%, of the total length of the vane so as to minimize the torque necessary to adjust the angle of the vanes against the force exerted by the fluid exiting from the impeller exit.

Depending on operating conditions or applications, it may not be necessary to set the vane angle at nearly zero degree. In such cases, it is permissible to shorten the length of the vanes so that when they are fully closed, there is an opening formed between the closed vanes.

Another feature of the present invention is aimed at this type of operation so that the length of the vanes is determined on a basis of the minimum flow rate expected to be handled by the turbomachinery.

By making the vane length as short as permissible under the operating condition expected, the frictional loss due to fluid resistance against the vanes can be minimized so as to prevent vibrations and minimize noises generated around the vanes. This feature is also useful for lessening the demand for excessive toughness in the diffuser vanes.

In those specific cases for minimizing the fluid resistance by basing the calculation on the minimum size of the opening ($A_4$) and on the size of the opening ($A_5$) at a design flow rate, the quantity $A_4$ can be approximated by the size of the opening between adjacent vanes when they are fully closed at a vane angle close to zero degree. For a given angle of the vanes, the quantity $A_5$ can be computed by subtracting the equivalent area based on the thickness of a vane measured in the peripheral direction at the radial location of the attachment from the size of the opening.

DESCRIPTION OF THE PREFERRED EMBODIMENTS

Preferred embodiments of the turbomachinery will be explained in the following with reference to the drawings.

Figure 6:
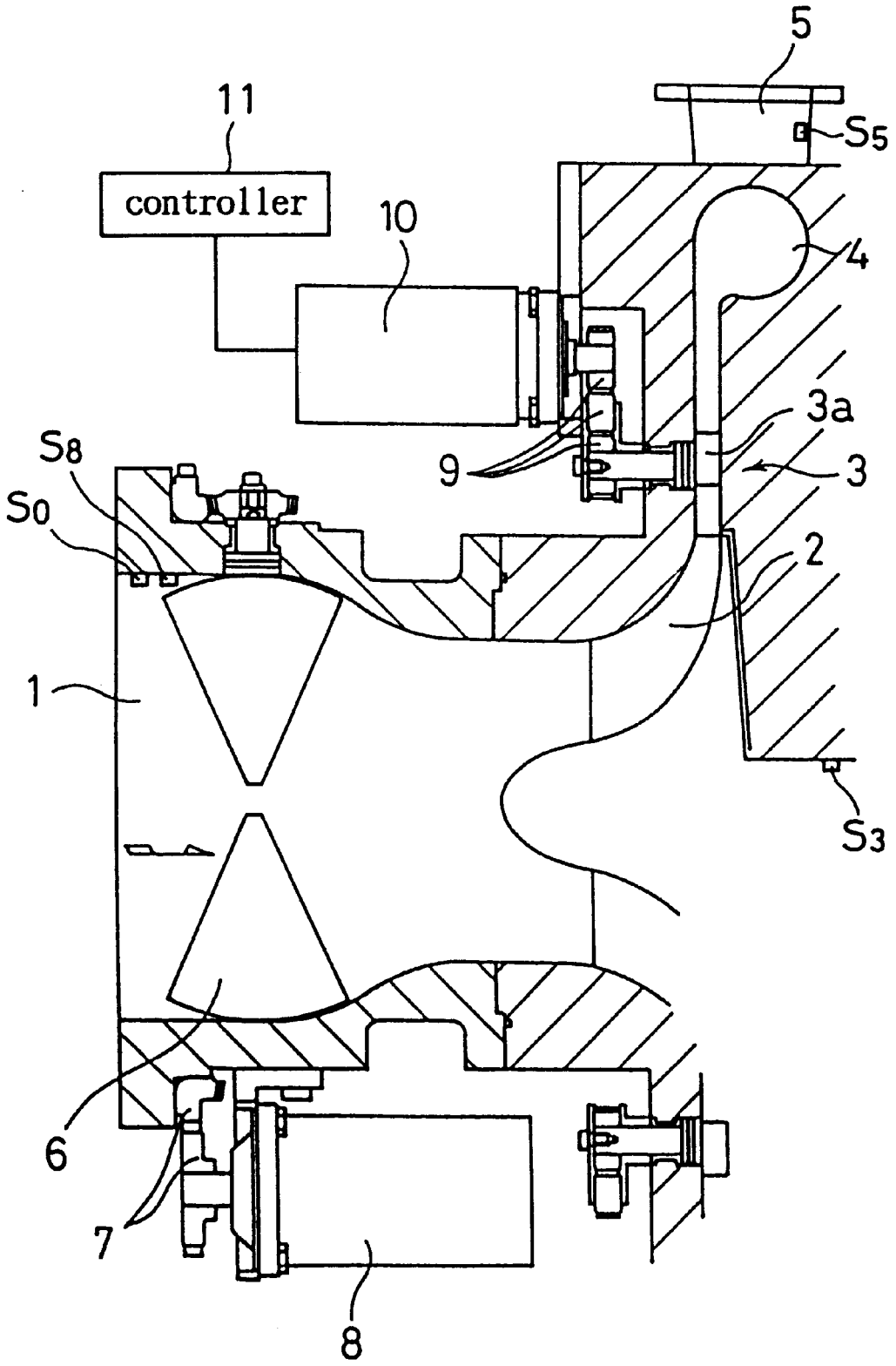
FIG. 6 is a cross sectional view of an application of the turbomachinery having variable guide vanes of the present invention to a single stage centrifugal compressor.
Figure 7:
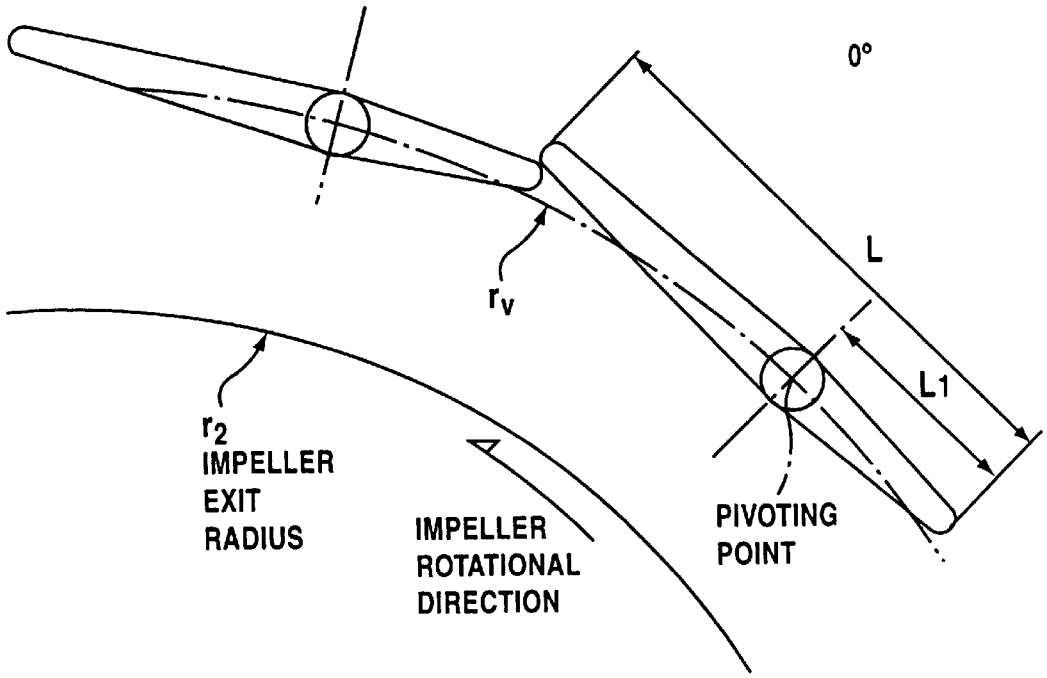
FIG. 7 is a drawing to show an opening section formed between two adjacent plate-type diffuser vanes oriented at an angle of 0 degree.
Figure 8:
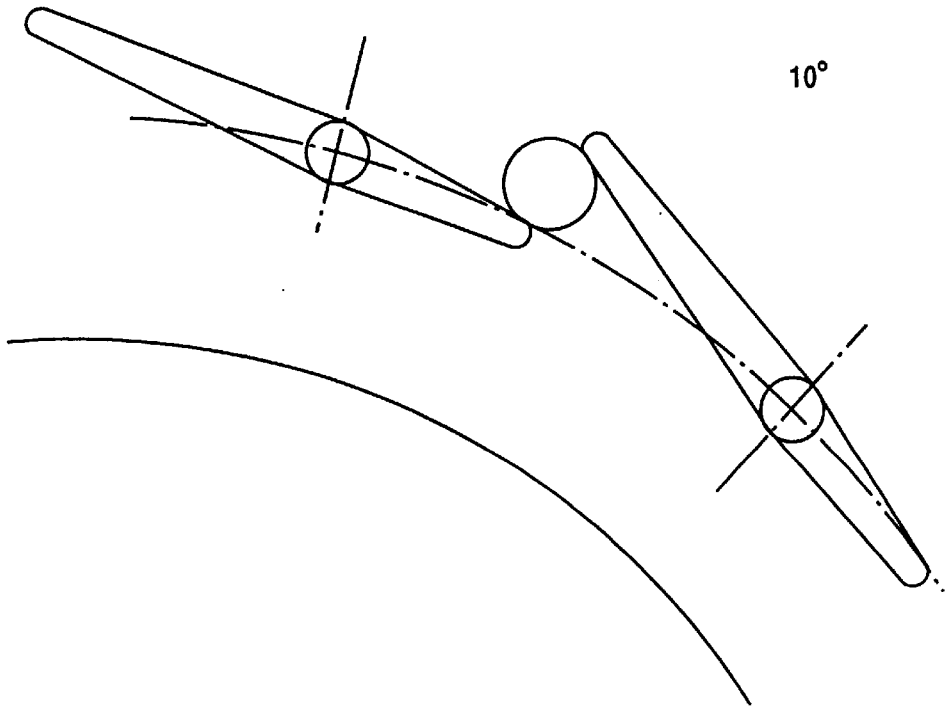
FIG. 8 is a drawing to show an opening section formed between two adjacent plate-type diffuser vanes oriented at an angle of 10 degrees.
Figure 9:
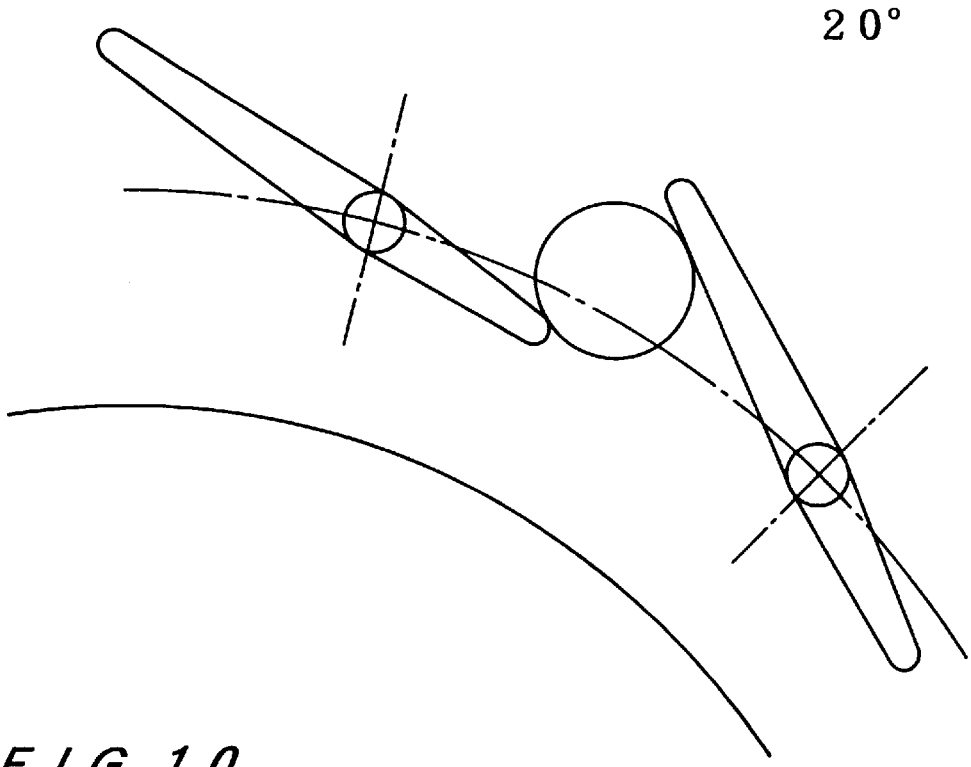
FIG. 9 is a drawing to show an opening section formed between two adjacent plate-type diffuser vanes oriented at an angle of 20 degrees.
Figure 10:
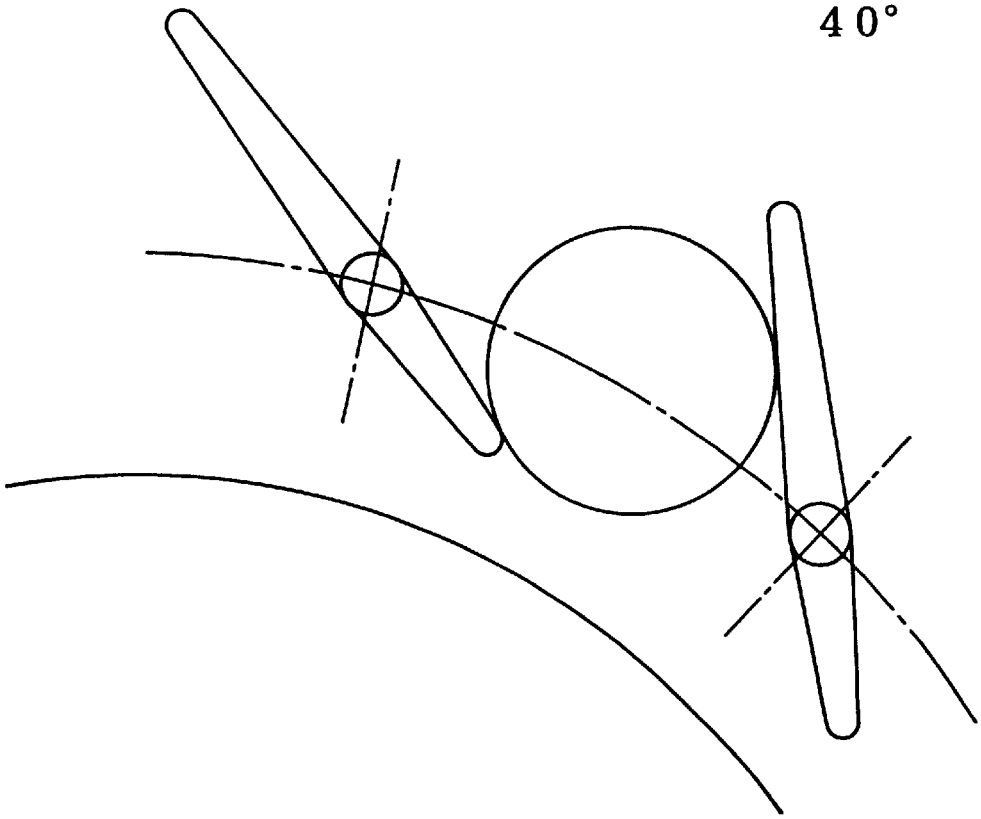
FIG. 10 is a drawing to show an opening section formed between two adjacent plate-type diffuser vanes oriented at an angle of 40 degrees.
Figure 11:
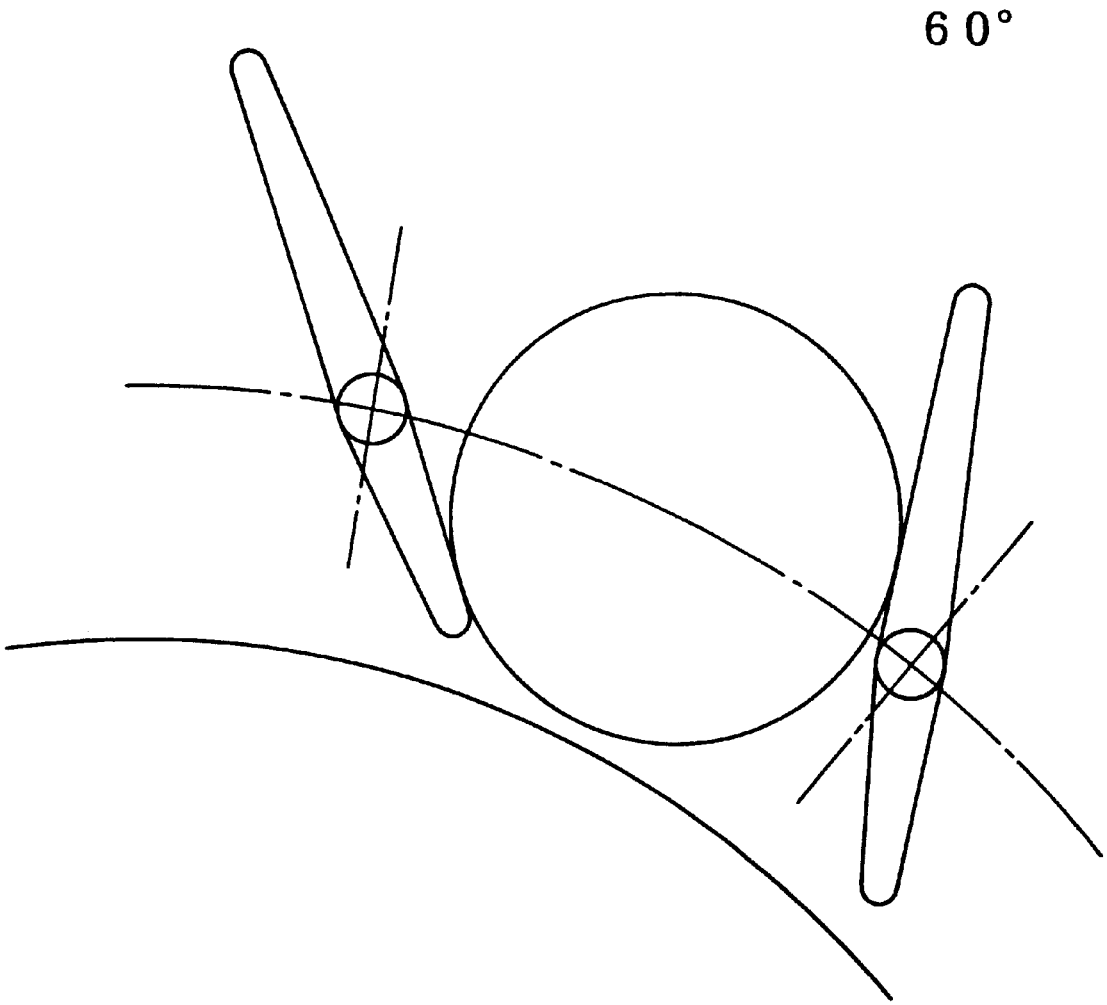
FIG. 11 is a drawing to show an opening section formed between two adjacent plate-type diffuser vanes oriented at an angle of 60 degrees.
Figure 12:
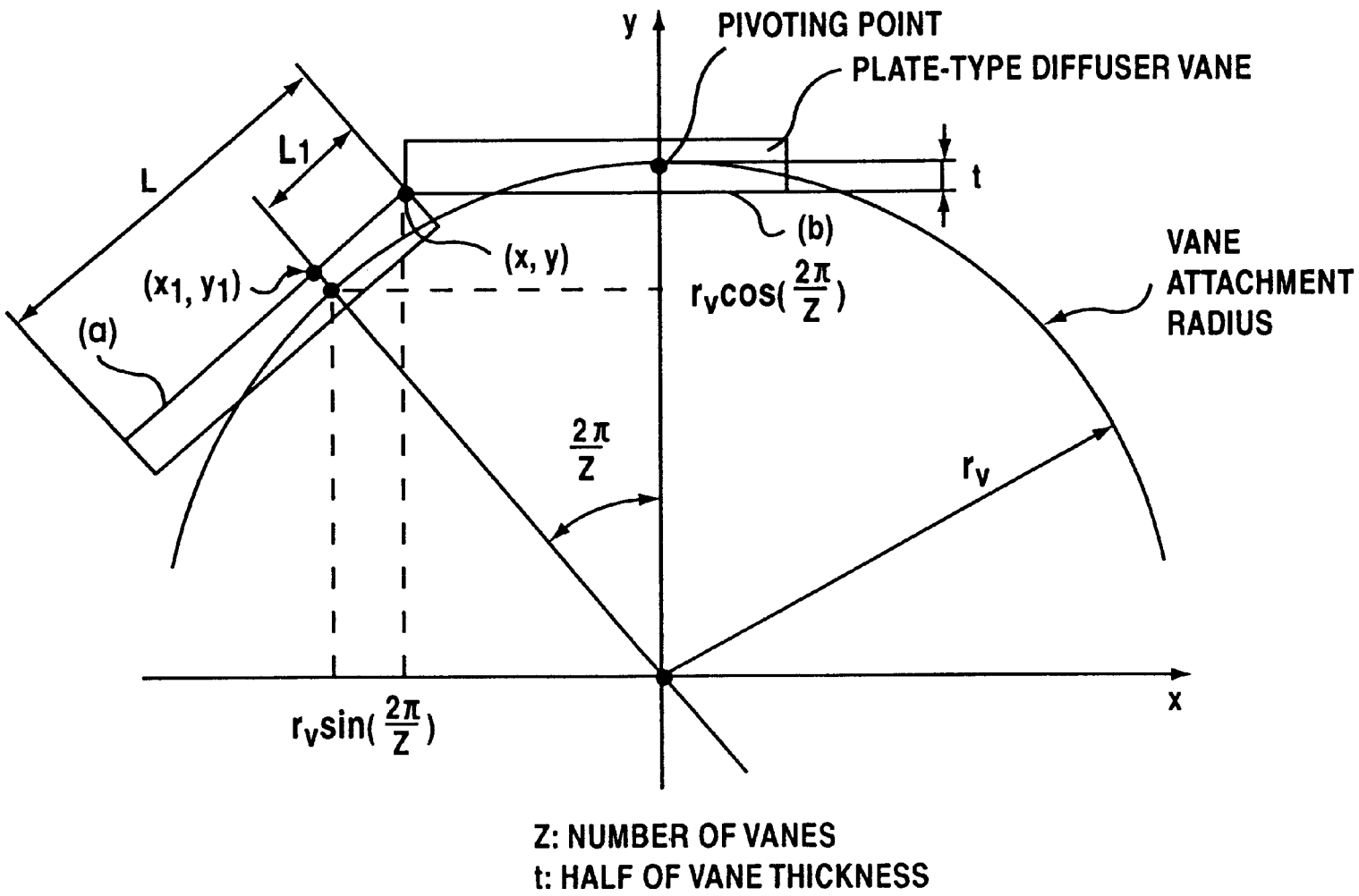
FIG. 12 shows a geometrical arrangement necessary to avoid the rotating impeller touching the diffuser vanes when the diffuser vanes are oriented at an angle of 0 degree.

FIG. 6 is a cross-sectional view of a single stage centrifugal compressor for use with the turbomachinery having adjustable diffuser vanes. The flowing into the compressor through the inlet pipe 1 is given motion energy by the rotating impeller 2, is sent to the diffuser 3 to increase the fluid pressure, and is passed through the scroll 4, and discharged from the exit pipe 5. The impeller shaft is connected to an electrical motor M (not shown). The inlet pipe 1 is provided with a plurality of inlet guide vanes 6, in the peripheral direction, connected to an actuator 8 coupled to a transmission device 7. The diffuser 3 is provided with diffuser vanes 3*a* which are also connected to an actuator 10 through a transmission device 9. The actuators 8, 10 are controlled by a controller 11 connected to a CPU 12.

An inlet flow rate detection device $S_0$ is provided on the inlet side of the compressor, and a rotational speed sensor $S_2$ is provided on the impeller shaft. An inlet pressure sensor $S_8$ and a exit pressure sensor $S_5$ are respectively provided on the inlet pipe 1 and the discharge pipe 5. The actuator 10 is operatively connected to the controller 11 to alter the angle of the diffuser vanes 3*a*.

As can be seen from this example, the turbomachinery can be used with a pumping system having inlet guide vanes 6. If the motor is driven at a constant velocity, there is no need for a rotational speed sensor $S_8$.

The diffuser vanes used for the compressor of this embodiment are the plate-type shown in FIGS. 7 to 11. The length of a diffuser vane is about equal to or slightly longer than a value obtained by dividing the circumference length (at the vane attachment radius location) of the impeller by the number of diffuser vanes. Therefore, when the vanes are fully closed at close to a zero degree at tangent to the circumference, the adjacent vanes touch each other at the leading edge of one vane over the trailing edge of the other vane.

Also, the radial position of the pivoting point of the diffuser vanes for adjusting the vane angle is selected to be within a range between 1.08 to 1.65 times the radius of the impeller so as to prevent the vanes mechanically interfering with the impeller even when they are fully opened at 90 degrees.

The length between the leading edge of the diffuser vane and the pivoting point is selected to be within 20 to 50%, more preferably 30 to 50%, of overall vane length so as to minimize the rotation torque necessary for adjusting the angle of the diffuser vanes during operation against the resistance force generated by the flowing fluid from the impeller acting on the vanes.

The controller 11 outputs driving signals to the actuator 10 on the basis of the input signals from the detection devices $S_0$, $S_2$, $S_5$ and $S_8$ and a pre-determined correlation presented below, so as to adjust the orientation of the diffuser vanes 3*a*. This correlation is established by the following equation based on the analysis of the fluid dynamics presented in Summary. For a compressible fluid, the equation is given by:

$$\alpha = arctan(Q/(K_1N - K_2Q)) \quad (1)$$

and for an incompressible fluid, the equation is given by:

$$\alpha = arctan[(1/P_r)^{1/\kappa}Q/\{K_1N - (1/P_r)^{1/\kappa}K_2Q\}] \quad (2)$$

where $\alpha$ is a diffuser vane angle, Q is an inlet flow rate, $K_1$ is a fixed constant given by $(\pi D_2)^2\sigma b_2 B$, N is the rotational speed of the impeller, $K_2$ is a fixed constant given by $\cot\beta_2$, $\sigma$ is a slip factor, $\beta_2$ is a blade exit angle of the impeller measured from tangential direction, $D_2$ is the exit diameter of the impeller, $b_2$ is an exit width of the impeller, B is a blockage factor and $P_r$ is a pressure ratio at inlet/exit of the compressor.

Figure 1:
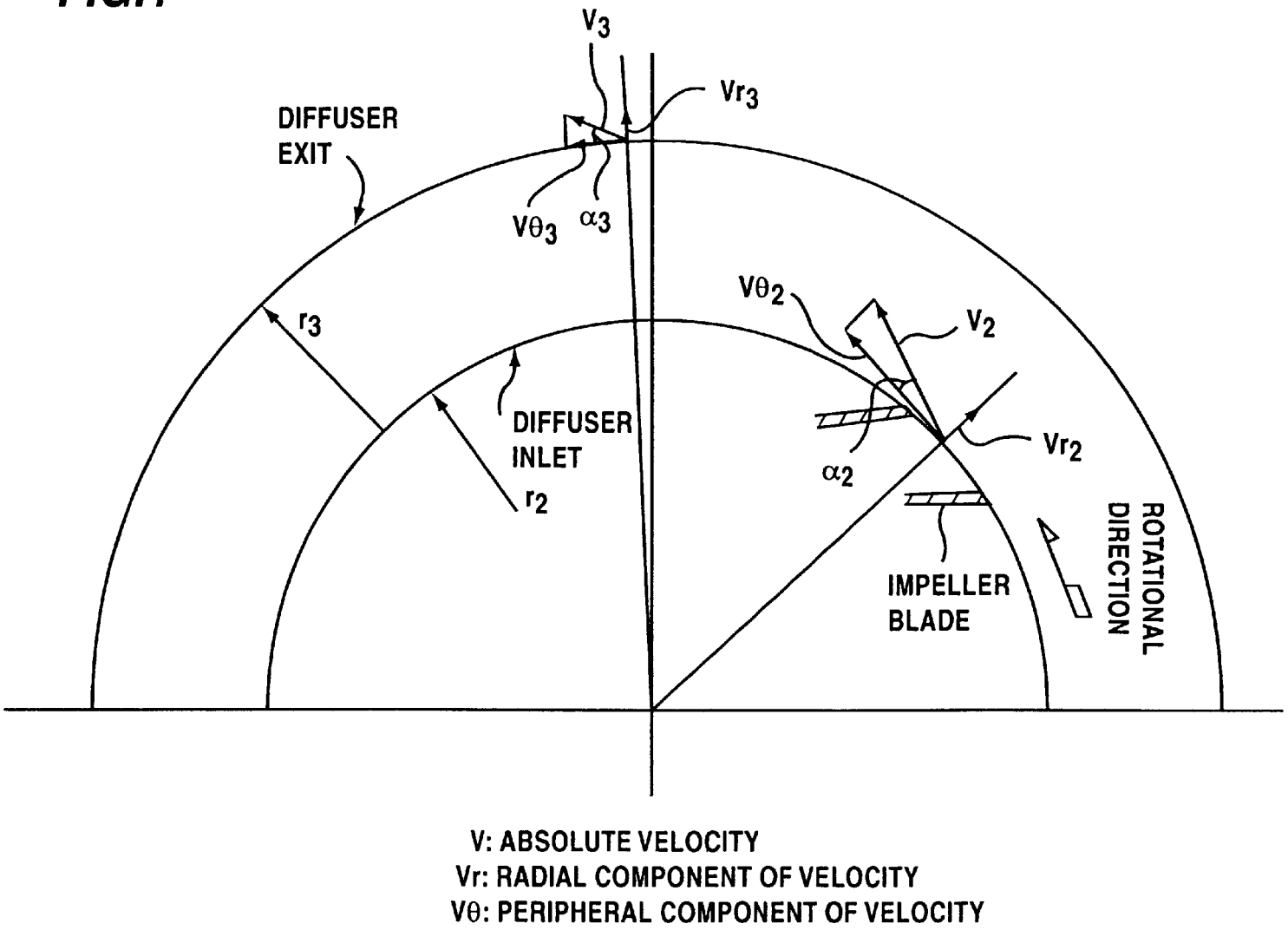
FIG. 1 is an illustration of the flows in a vaneless diffuser.
Figure 2:
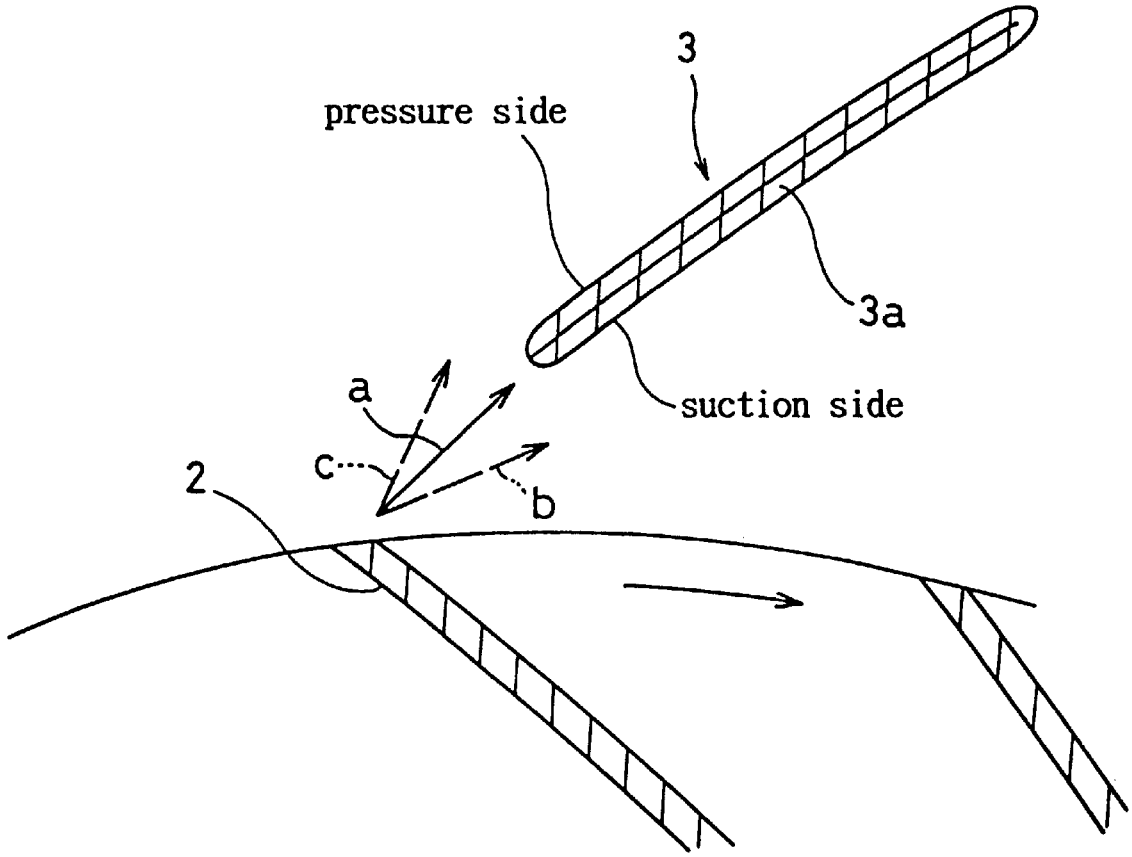
FIG. 2 is a schematic drawing to show the directions of flows at the impeller exit.
Figure 3:
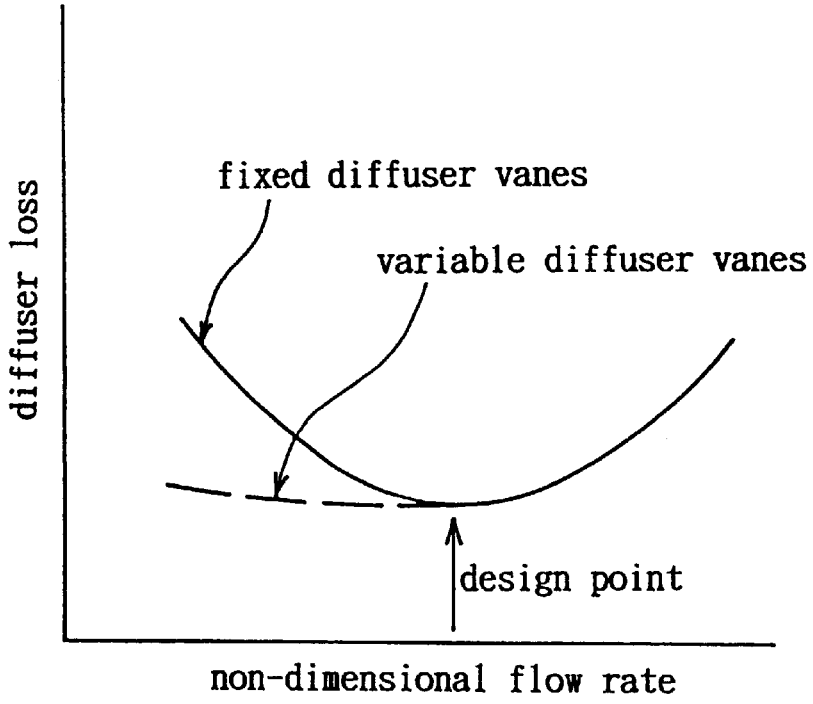
FIG. 3 is a graph showing the relationship between the diffuser loss and the non-dimensional flow for fixed vane and adjustable vane diffusers.
Figure 4:
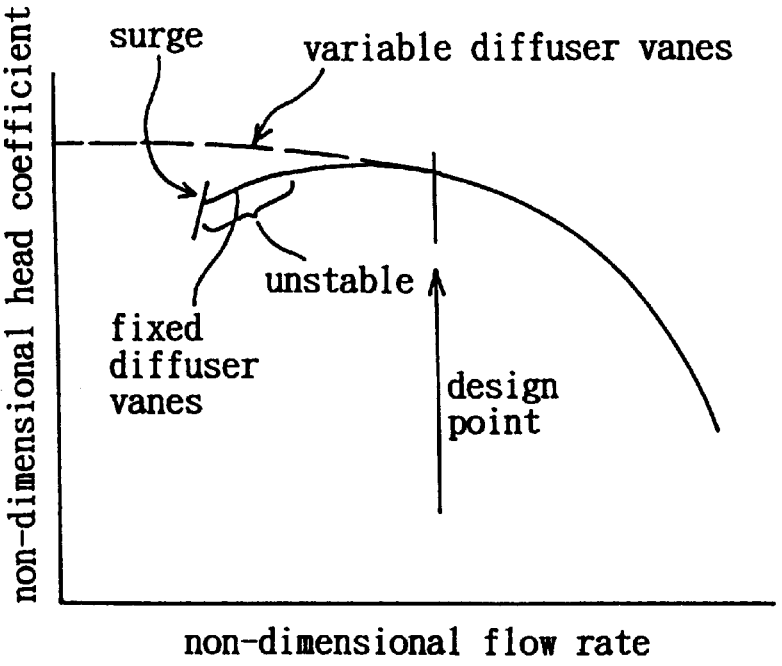
FIG. 4 is a graph showing the relationship between the non-dimensional head coefficient and the non-dimensional flow rate for fixed vane and adjustable vane diffusers.
Figure 5:
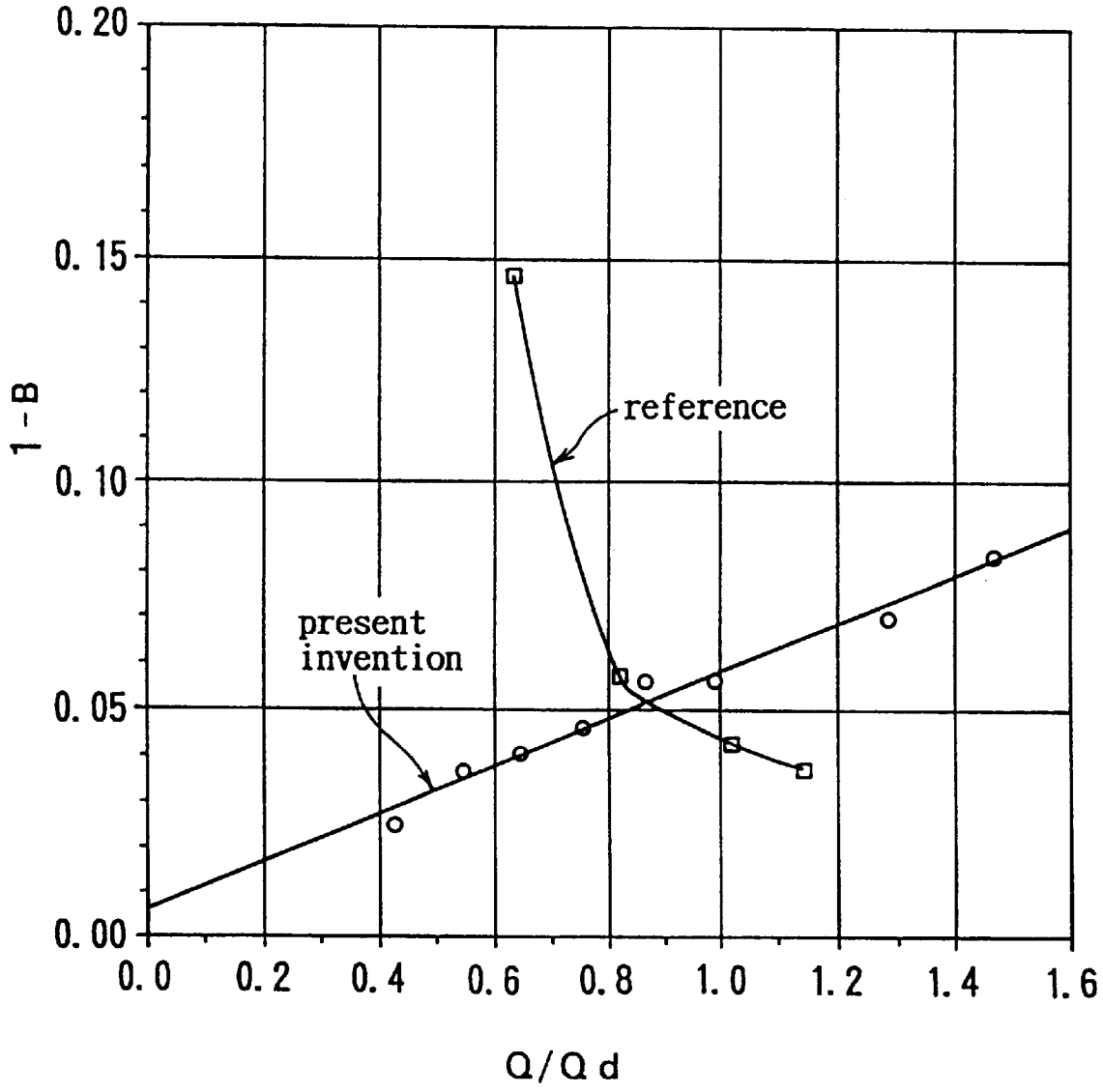
FIG. 5 is a graph showing the relationship between the blockage factor and the non-dimensional flow rate.

By adjusting the diffuser vane angle according to the equations presented above, the diffuser loss at the diffuser vanes 3*a* can be prevented as shown by a broken line in FIG. 3. The result is that the overall efficiency of the compressor is improved by avoiding an onset of instability and maintaining stable impeller performance down to low flow rates, as shown by the broken line shown in FIG. 4.

When the pumping system is provided with a variable-speed impeller, and if a specified head value cannot be obtained by adjusting the diffuser vane angle according to either equation (1) or (2) and measured flow rate, then the rotational speed of the impeller can also be varied to avoid an onset of instability.

Figure 13:
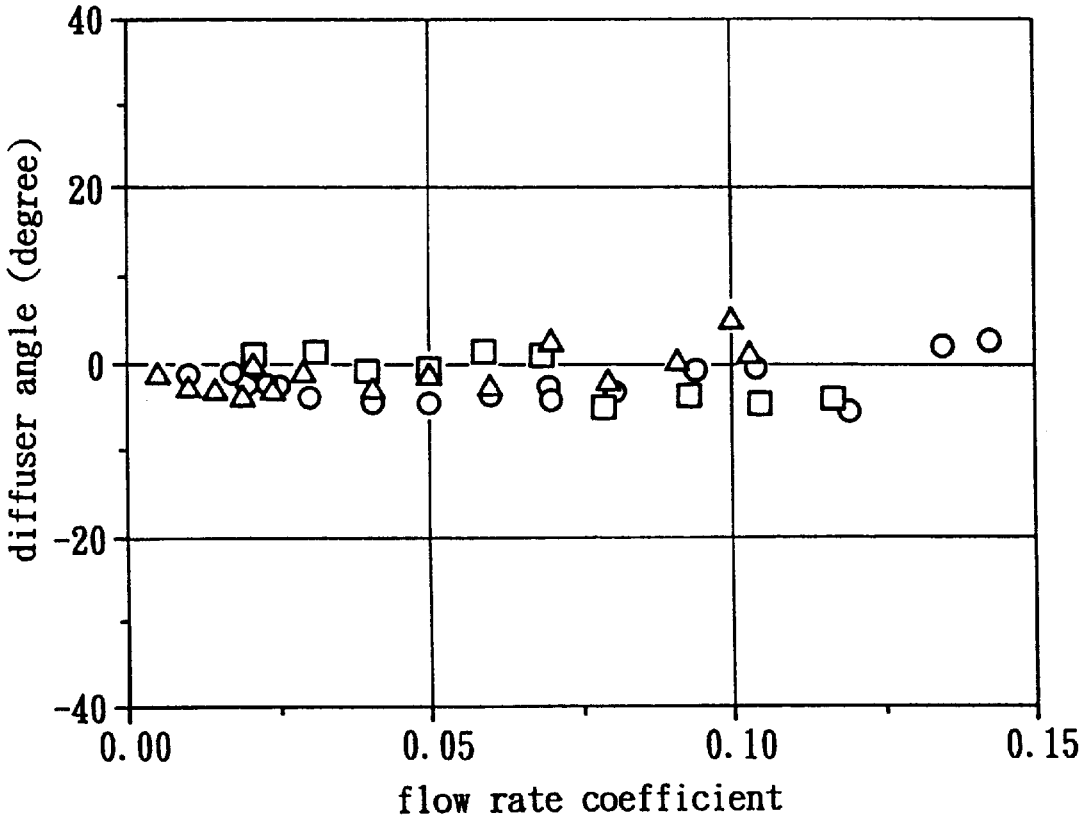
FIG. 13 is a graph showing the difference between theoretical results according to equation (2) and experimental results using the compressor shown in FIG. 6.

FIG. 13 shows a comparison between experimental results of vane angles and theoretical results as a function of the flow coefficient. The diffuser vane angles to prevent surge at different flow rates were determined experimentally and were compared with the calculated diffuser vane angles by using suitable parameter values in equation (2). The results validate the correlation equations for predicting the performance of the compressor.

In FIG. 13, circles indicate the results obtained at Mach No. of 0.87 (a ratio of a peripheral impeller velocity to the velocity of sound at the inlet to the compressor) and the inlet guide vane angle of 0 degree (fully open); triangles are those at Mach No. of 0.87 and the inlet guide vane angle of 60 degrees; and squares are those at Mach No. of 1.21 and the inlet guide vane angle of 0 degree (fully open). These results demonstrate that regardless of the peripheral velocity of the impeller, i.e. rotational speed of the impeller, whether or not swirling flow is present at the inlet to the impeller by the inlet guide vanes, the equations (1) and (2) are valid for determining an optimum angle of the diffuser vanes for each flow rate.

Figure 14:
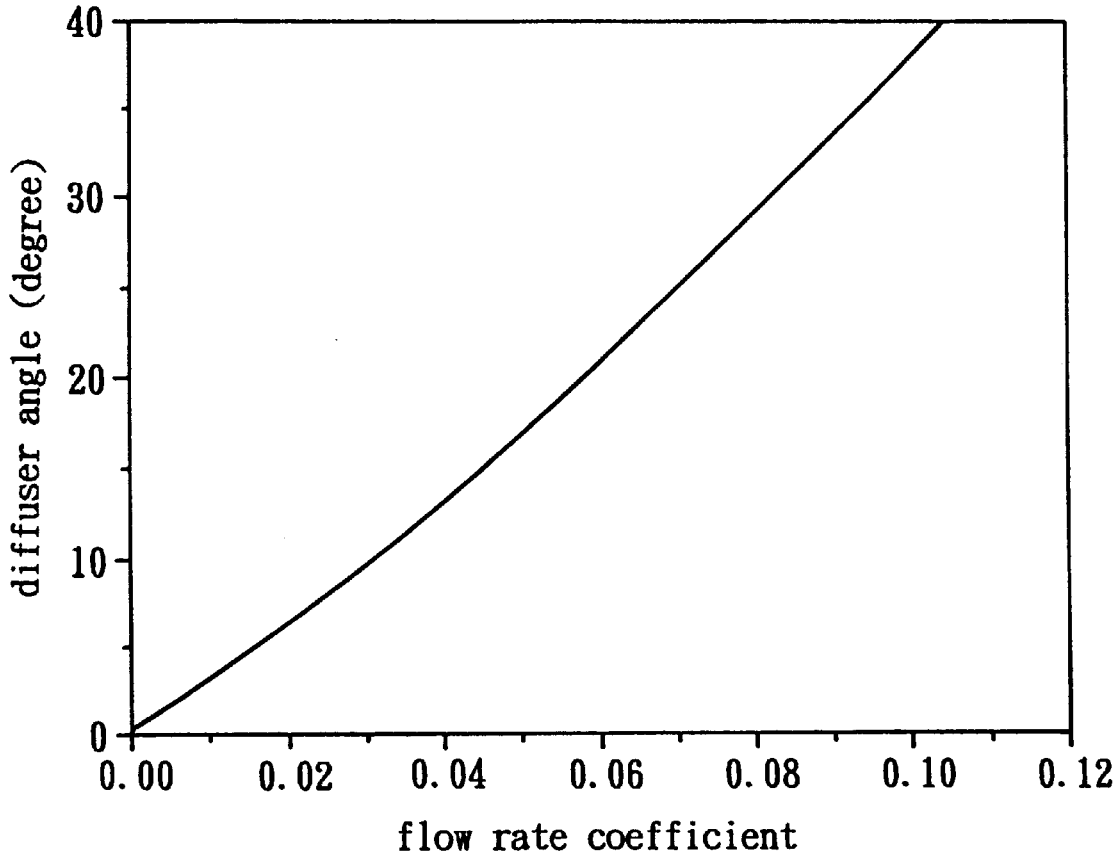
FIG. 14 is a graph showing the diffuser vane angle according to equation (2) and the flow coefficient.

FIG. 14 illustrates a relationship of the theoretical angles for the diffuser vanes by plotting the equation (2) against the flow coefficients, and shows that the correlation can be approximated with a second order curve.

Figure 15:
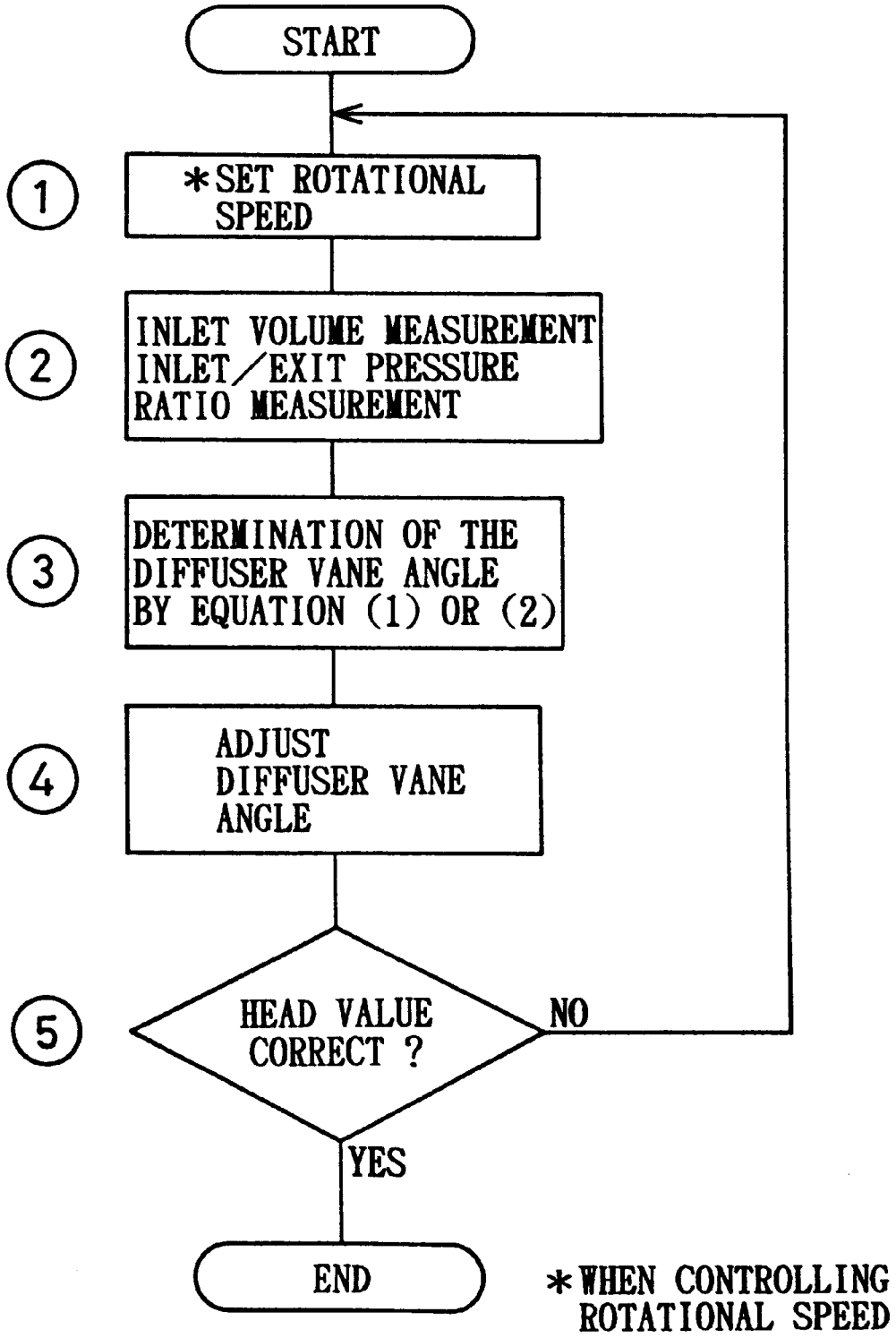
FIG. 15 is a flowchart showing the operational steps for the turbomachinery of the present invention having adjustable diffuser vanes.

FIG. 15 shows a flowchart of the operating step for the turbomachinery. In the following description, "it" refers to CPU 12. As shown in FIG. 15, when the rotational speed is to be controlled, a predetermined speed is entered in step 1. When the speed is not to be controlled, it proceeds to step 2. In step 2, the inlet volume and, if necessary, the ratio of inlet and exit pressures are determined from measurements, and it proceeds to step 3. In step 3, using either equation (1) or (2), the diffuser vane angle is determined, and in step 4, the diffuser vane angle is adjusted.

If it is necessary to control the rotational speed, then it proceeds to step 5 to check whether a specified head value is generated, if it is not, then it returns to step 1.

Figure 16:
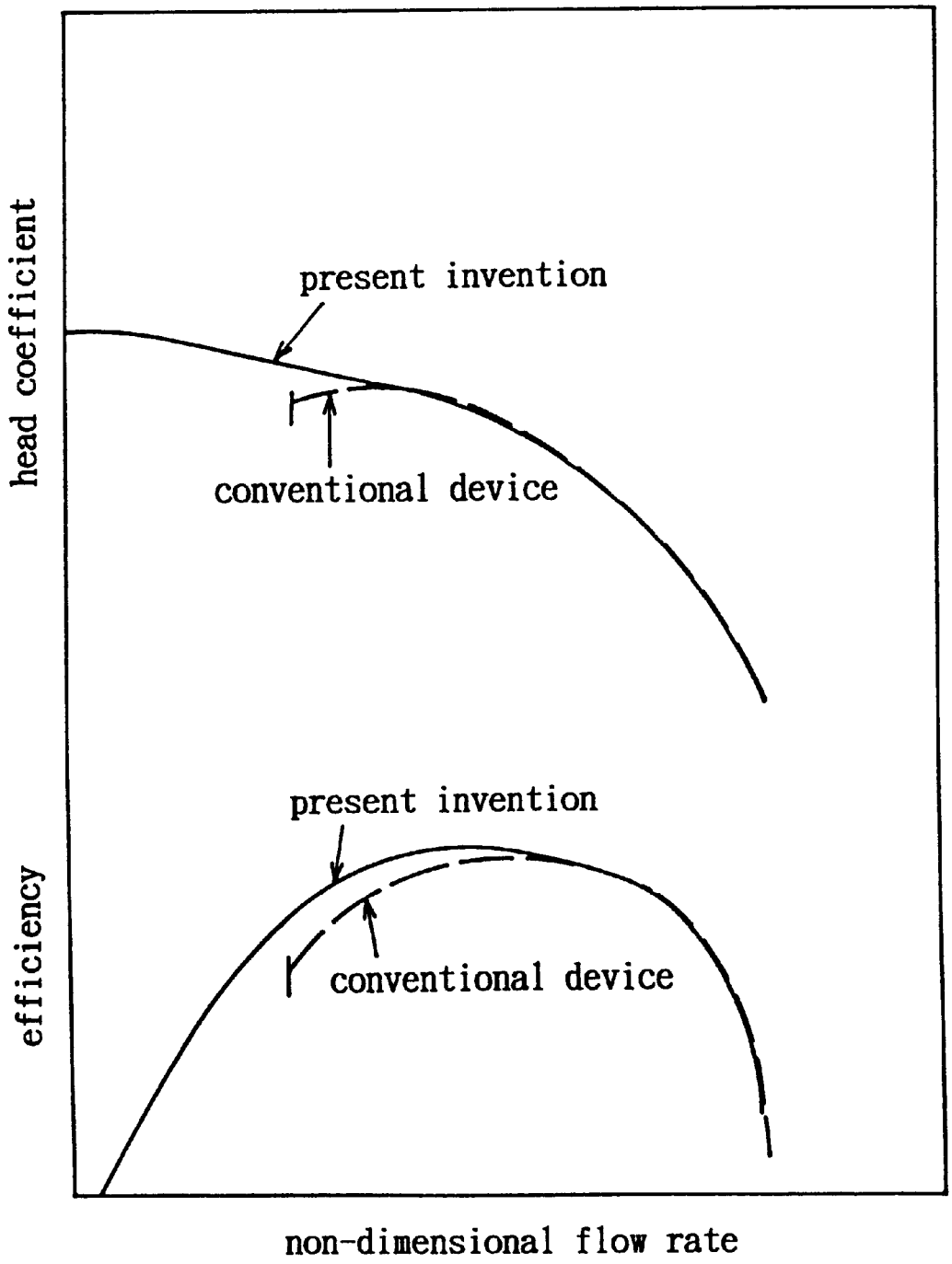
FIG. 16 is a graph showing the relationship between the non-dimensional head coefficient and the non-dimensional flow rate.

FIG. 16 shows a comparison of the overall performance of the conventional turbomachinery with fixed-vane-type diffuser and the turbomachinery of the present invention with variable diffuser vane. It can be seen that the present turbomachinery achieves a stable operation down to as low as the shut-off flow rate in comparison to the conventional turbomachinery.

FIGS. 18 to 21 illustrate the vane configurations, including the size of the opening section, which is indicated by a circle, formed by orienting airfoil-type diffuser vanes at various angles to the tangential direction. FIGS. 22 to 25 relate to the corresponding cases for arched plate-type vanes. The results show that the size of the opening depends only on the thickness of the vanes, and all of the different types of vanes show approximately the same behavior in operation, leading to a conclusion that size of the opening does not depend on the shape of the vanes.

Figure 17:
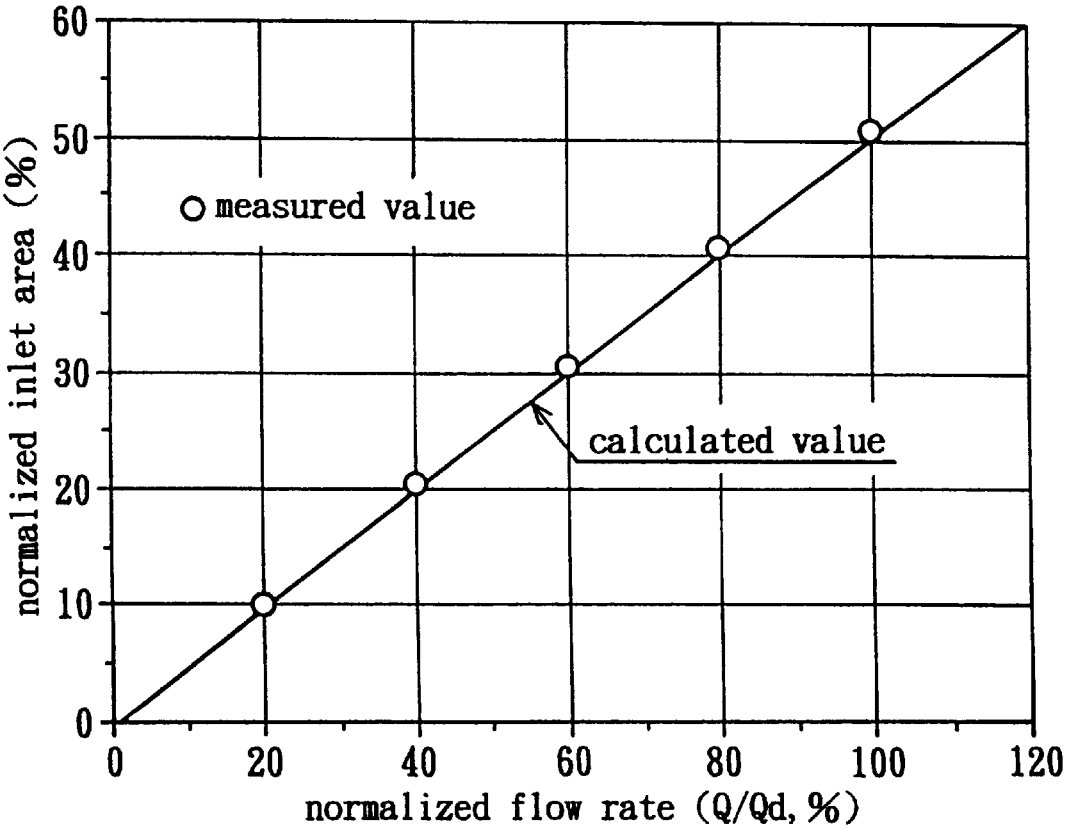
FIG. 17 is a graph showing a relationship between normalized area of the opening section between vanes and normalized flow rate.
Figure 18:
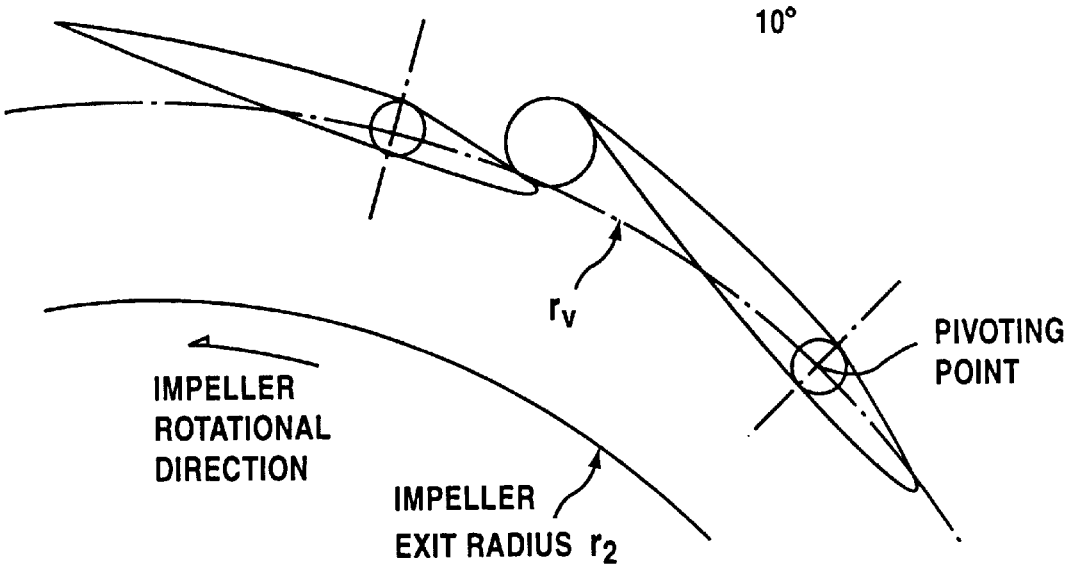
FIG. 18 is a drawing to show an opening section formed between two adjacent airfoil-type diffuser vanes oriented at an angle of 10 degrees.
Figure 19:
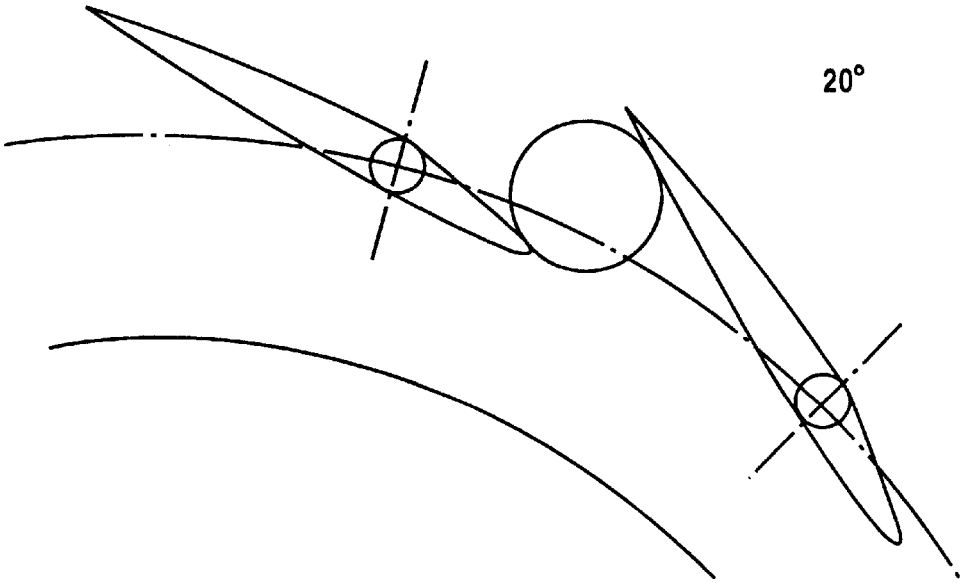
FIG. 19 is a drawing to show an opening section formed between two adjacent airfoil-type diffuser vanes oriented at an angle of 20 degrees.
Figure 20:
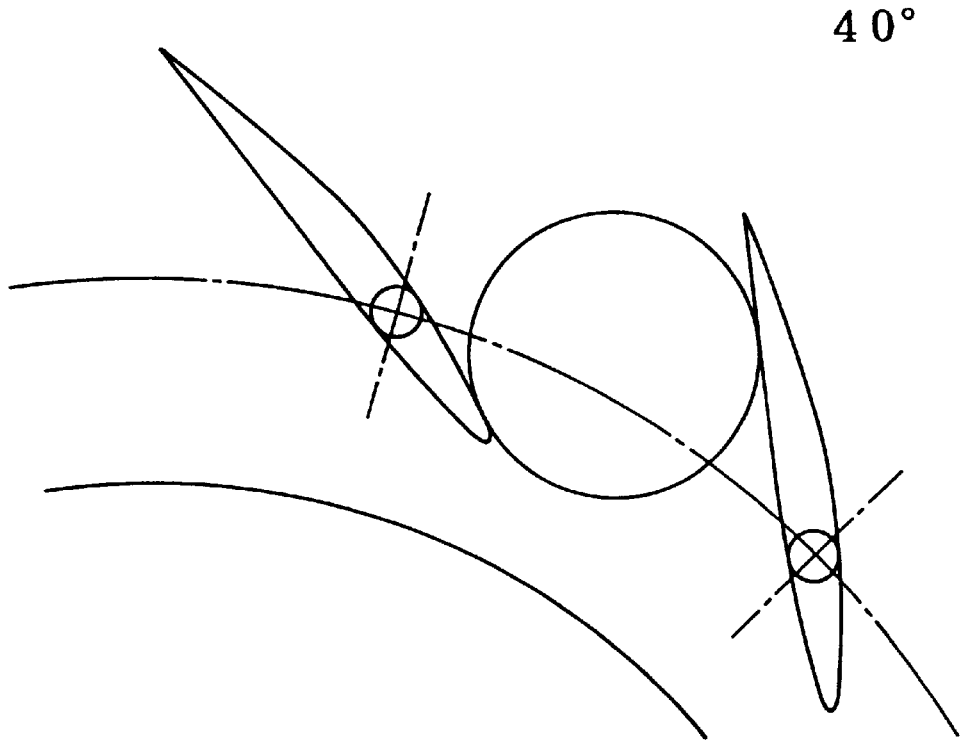
FIG. 20 is a drawing to show an opening section formed between two adjacent airfoil-type diffuser vanes oriented at an angle of 40 degrees.
Figure 21:
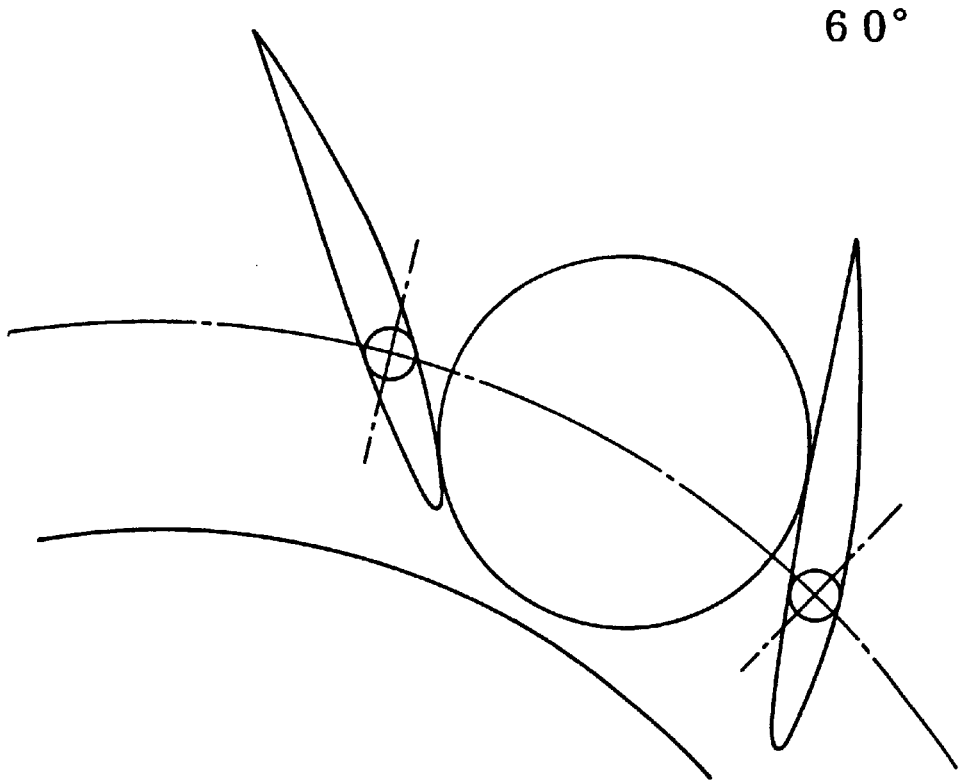
FIG. 21 is a drawing to show an opening section formed between two adjacent airfoil-type diffuser vanes oriented at an angle of 60 degrees.
Figure 22:
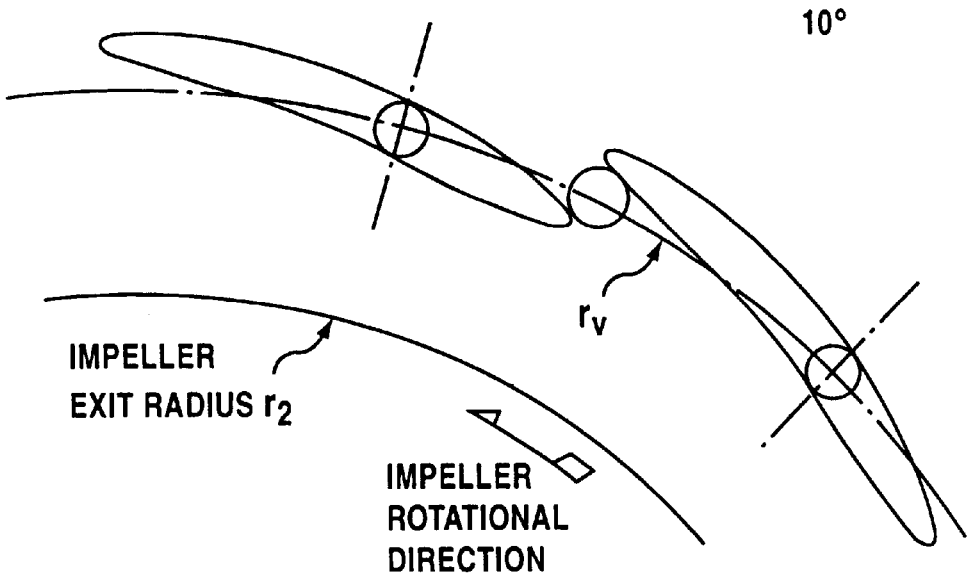
FIG. 22 is a drawing to show an opening section formed between two adjacent arched plate-type diffuser vanes oriented at an angle of 10 degrees.
Figure 23:
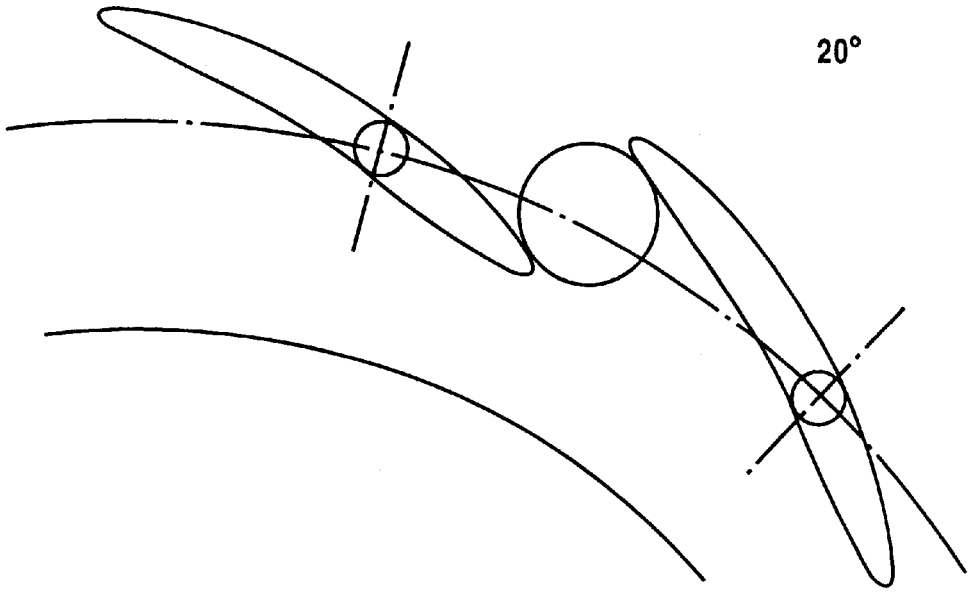
FIG. 23 is a drawing to show an opening section formed between two adjacent arched plate-type diffuser vanes oriented at an angle of 20 degrees.
Figure 24:
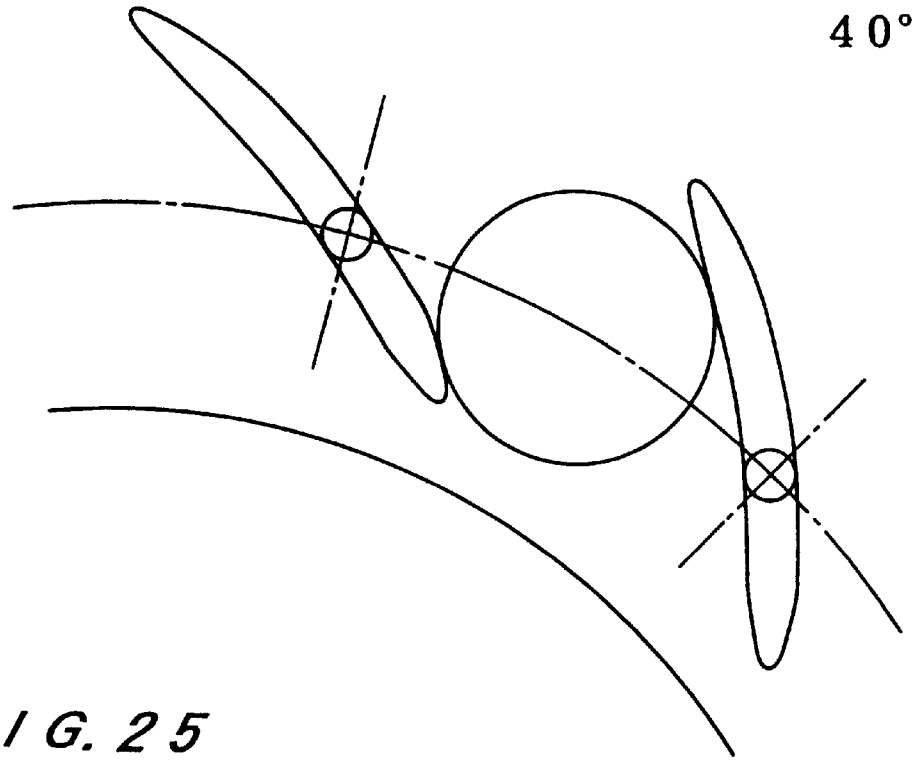
FIG. 24 is a drawing to show an opening section formed between two adjacent arched plate-type diffuser vanes oriented at an angle of 40 degrees.
Figure 25:
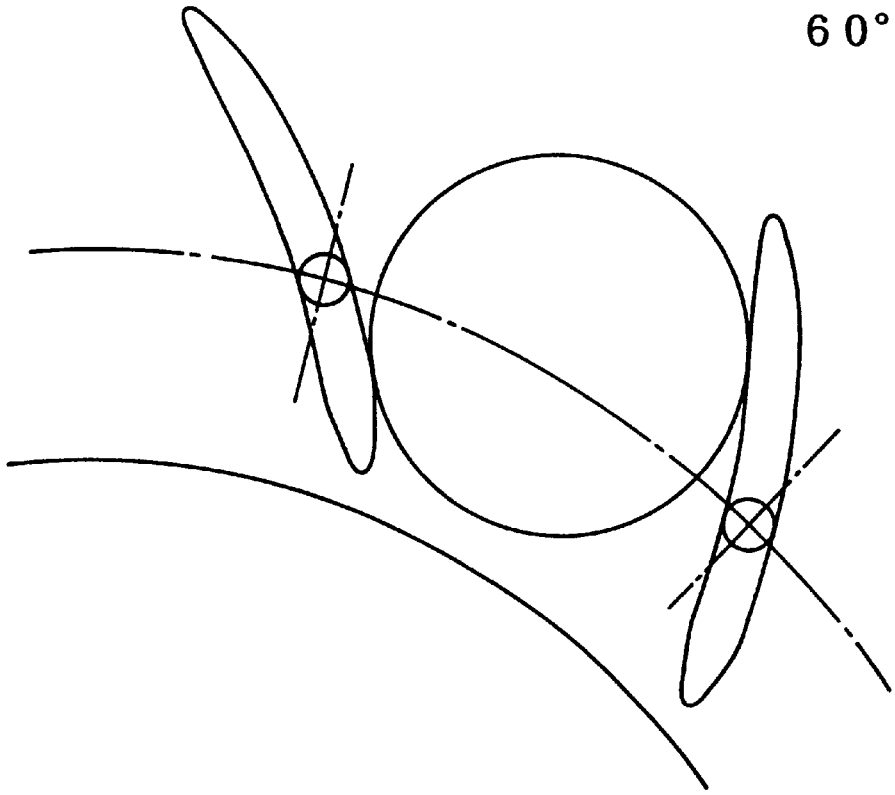
FIG. 25 is a drawing to show an opening section formed between two adjacent arched plate-type diffuser vanes oriented at an angle of 60 degrees.

FIG. 17 shows a control methodology in an another embodiment turbomachinery similar to the one shown in FIG. 6, therefore the explanation for the turbomachinery itself will be omitted. In this embodiment, the vane angles are controlled by regulating the inlet flow rate to adjust the size of the opening formed between the vanes. The method of obtaining the correlation in FIG. 17 is the same as that presented earlier.

In FIG. 17, the normalized inlet area, which a ratio of inlet area $2\pi r_v b_2$ at the inlet radius $r_v$ to the size of the opening between the vanes shown in FIGS. 7 to 11 and FIGS. 18 to 25, are plotted against the normalized flow rate which is a ratio of flow rate Q to the design flow rate $Q_d$. The results are almost linear, and the area ratios depend only on the vane thickness, and it was found that the correlation was the same for different shapes of vanes. It is therefore concluded that the area ratio is independent of the vane shape. Using the correlation shown in FIG. 17 between the normalized inlet area and the normalized flow rate, it is possible to determine the size of the opening of the diffuser vanes from the flow rate Q.

Figure 26:
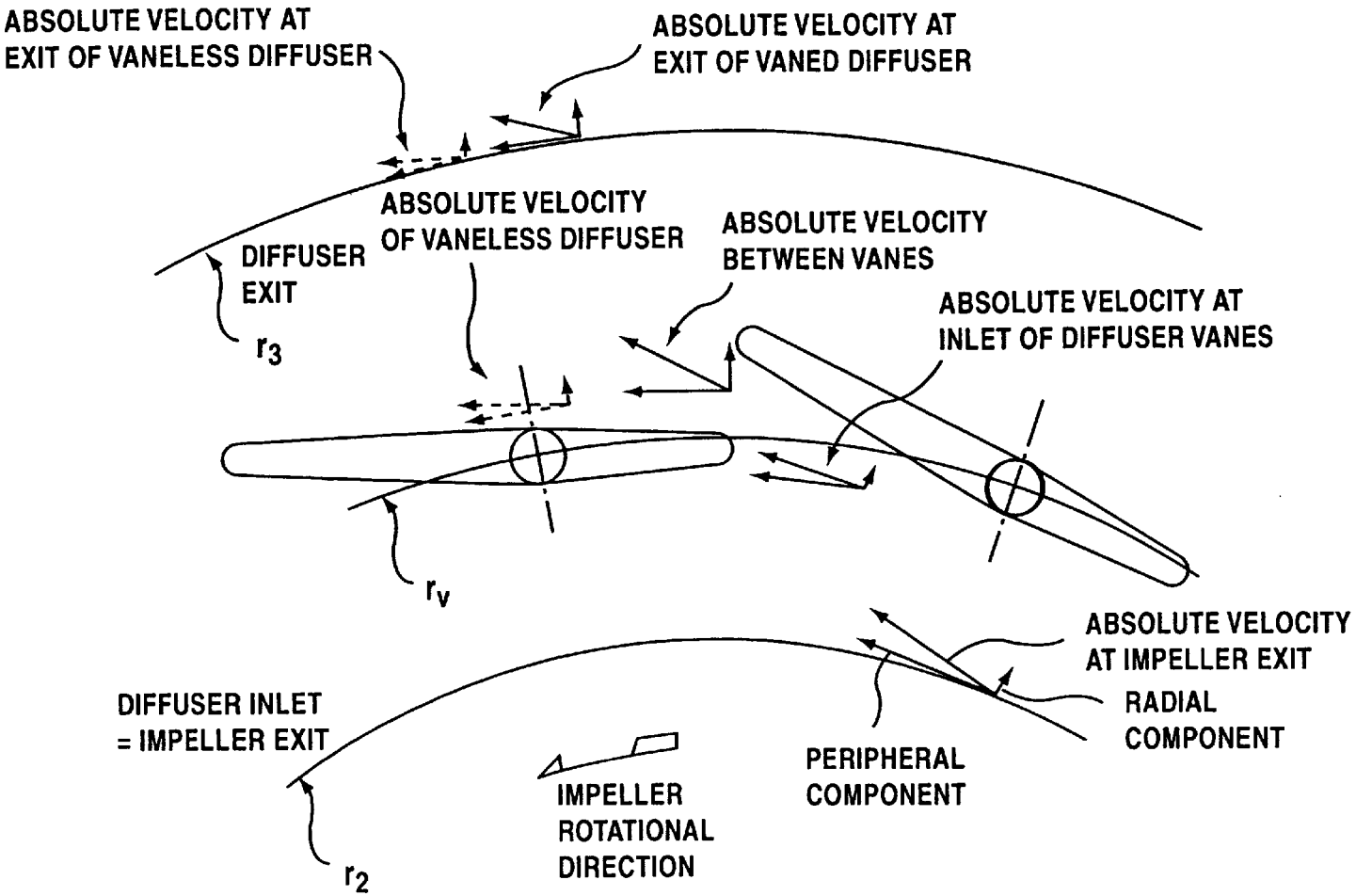
FIG. 26 is an illustration to show absolute velocity vectors at diffuser inlet and diffuser exit, and velocity vector components in the radial and peripheral directions for a given orientation of diffuser vanes.

FIG. 26 illustrates the distribution of various velocity vectors in a diffuser with vanes (solid lines) at a given diffuser vane angle, and a vaneless diffuser (broken lines). The velocity vectors include vectors of the absolute velocity of the flowing from the diffuser inlet (impeller exit) to the diffuser exit, and the vectors of the radial and peripheral velocity components.

At the inlet of the diffuser, the radial velocity vectors are relatively small because of low flow rate in this direction, and in case of the vaneless diffuser, the magnitude of the radial velocity component is reduced by the ratio of the diffuser radii up to the diffuser exit. These vectors are shown by broken lines in FIG. 17. It should be noted that FIG. 17 is based on average velocities, and reverse flows are not shown, however, in actual cases, because of the presence of the boundary layer, the flows near the wall surfaces are subject to flow separation and reverse flows can be generated.

When the exit flow from the impeller reaches the opening section formed between the diffuser vanes, there is a narrowing of the flow passage and the flow is accelerated in accordance with the normalized inlet shown in FIG. 17, and the flow angle becomes large. The velocity vectors for these velocity components are shown by solid lines which are almost normal to the flow path, and their magnitude is determined by the law of conservation of mass flow.

As demonstrated clearly in FIG. 17, the velocity vectors for the radial velocity components are accelerated several times the velocity vectors at the diffuser inlet section, because of decreasing size of the flow passage (opening). The result is that it has become possible to eliminate the problem of unstable flow in the diffuser at a low flow rate.

Furthermore, because both diffuser vane angle and the size of the opening can be changed simultaneously, it is possible to even more effectively suppress the reverse flow within the diffuser at a low flow rate and to operate the pumping system free from surge. By adopting such a control methodology, the compressor operates quite efficiently even at a flow rate lower than the design flow rate so that the radial velocity component does not become negative, no excessive loss is experienced and instability is avoided.

Figure 27:
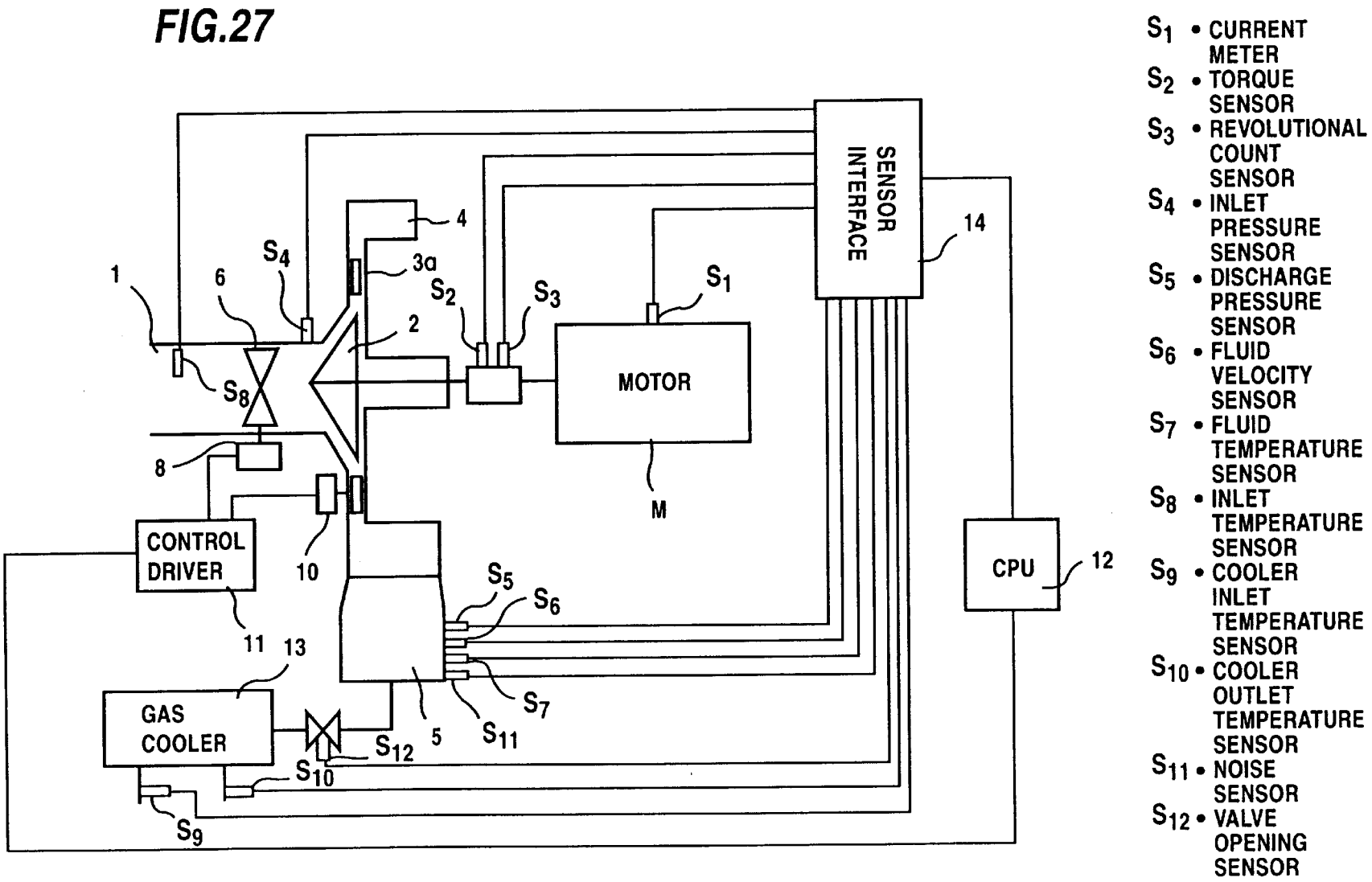
FIG. 27 is a block diagram of the control system for the turbomachinery of the present invention.

FIG. 27 shows another embodiment of the application of the turbomachinery having adjustable diffuser vanes. The compressor is provided with various sensors on its main body or on associated parts, such as current meter $S_1$ for the detection of input current to the electrical motor, a torque sensor $S_2$ and a rotational speed sensor $S_3$ for the impeller shaft; an inlet pressure sensor $S_4$ disposed on inlet pipe 1 for detection of inlet pressures; and $S_5$ to $S_7$ disposed on discharge pipe 1 for measuring, respectively, the discharge pressures, fluid velocities and flow temperatures; inlet temperature sensor $S_8$ for measuring inlet temperatures; cooler temperature sensors $S_9$ and $S_{10}$ for determining the temperature difference between the inlet and exit ports in the gas cooler 13; noise sensor $S_{11}$; and valve opening sensor $S_{12}$. These sensors $S_1$ to $S_{12}$ are operatively connected to a sensor interface 14 through which the output sensor signals are input into CPU 12.

In this embodiment turbomachinery, the methodology for controlling the diffuser vane angle is based on determining some operating parameter which bears a functional relationship to the inlet flow rate, and establishing a correlation between that operating parameter and the diffuser vane angles directly or indirectly. There are various kinds of operating parameters which can be used, and each of them will be discussed in some detail in the following.

(1) Input Current to Electrical Drive

If the compressor is driven by an electrical driver, an operating parameter related to the inlet flow rate can be an input current to the drive, which provides a reasonable measure of the inlet flow rate. The drive power L is given by:

$$L=\eta_m \cdot \eta_p \cdot V \cdot A=\rho \cdot g \cdot H \cdot Q/\eta$$

where $\eta_m$ is a driver efficiency; $\eta_p$ is a drive power factor; V is an input voltage to the driver; A is an input current to the driver; ρ is a fluid density; H is a head value; Q is an inlet flow rate; and η is the efficiency of the device being driven. Therefore, it can be seen that the driver current is a parameter of the inlet flow rate. However, it should be noted that there is a limit to the utility of this relation because the efficiency of the driven device decreases along with the decreasing flow rate, and the drive input power is a variable dependent on the fluid density and head values.

(2) Rotational Speed of the Electrical Drive

The drive power L is given by:

$$L=T \cdot \omega$$

where T is a torque value; and ω is an angular velocity. Thus, by measuring the speed of the drive and the resulting torque, it is possible to estimate the inlet flow rate to some extent. If the rotational speed of the drive is constant, then only the torque needs to be determined.

(3) Inlet Pressure

The flow rate Q flowing through the pipe is given by:

$$Q=A \cdot v=A \cdot (\rho \cdot (Pt-Ps)/2)^{1/2}$$

where A is the cross sectional area of the pipe; v is an average flow velocity in the pipe; Pt is a total pressure; and Ps is a static pressure. If the pressure at the inlet side is atmospheric, the total pressure can be made constant, so if the static pressure can be found, the inlet flow rate can be obtained. Therefore, by measuring the static pressure at the inlet constriction section of the compressor, it is possible to obtain data related to the inlet flow rate reasonably. In this case, it is necessary to measure the static pressure of the incoming flow accurately by eliminating the reverse flow which occurs from the impeller at a low flow rate.

(4) Exit Pressure

The exit pressure of the compressor can be measured to estimate the inlet flow rate. If the fluid is incompressible, the exit flow rate is equal to the inlet flow rate, but if the fluid is compressible, then it is necessary to have some method for determining the density of the fluid.

(5) Flow Velocity in the Pipe

The flow velocity within the pipe, similar to the inlet pressure, can be measured to provide some data for the inlet flow rate. Velocity measurement can be carried out by such methods as hot-wire velocity sensor, laser velocity sensor and ultrasound velocity sensor.

(6) Inlet/Exit Temperatures

Figure 28:
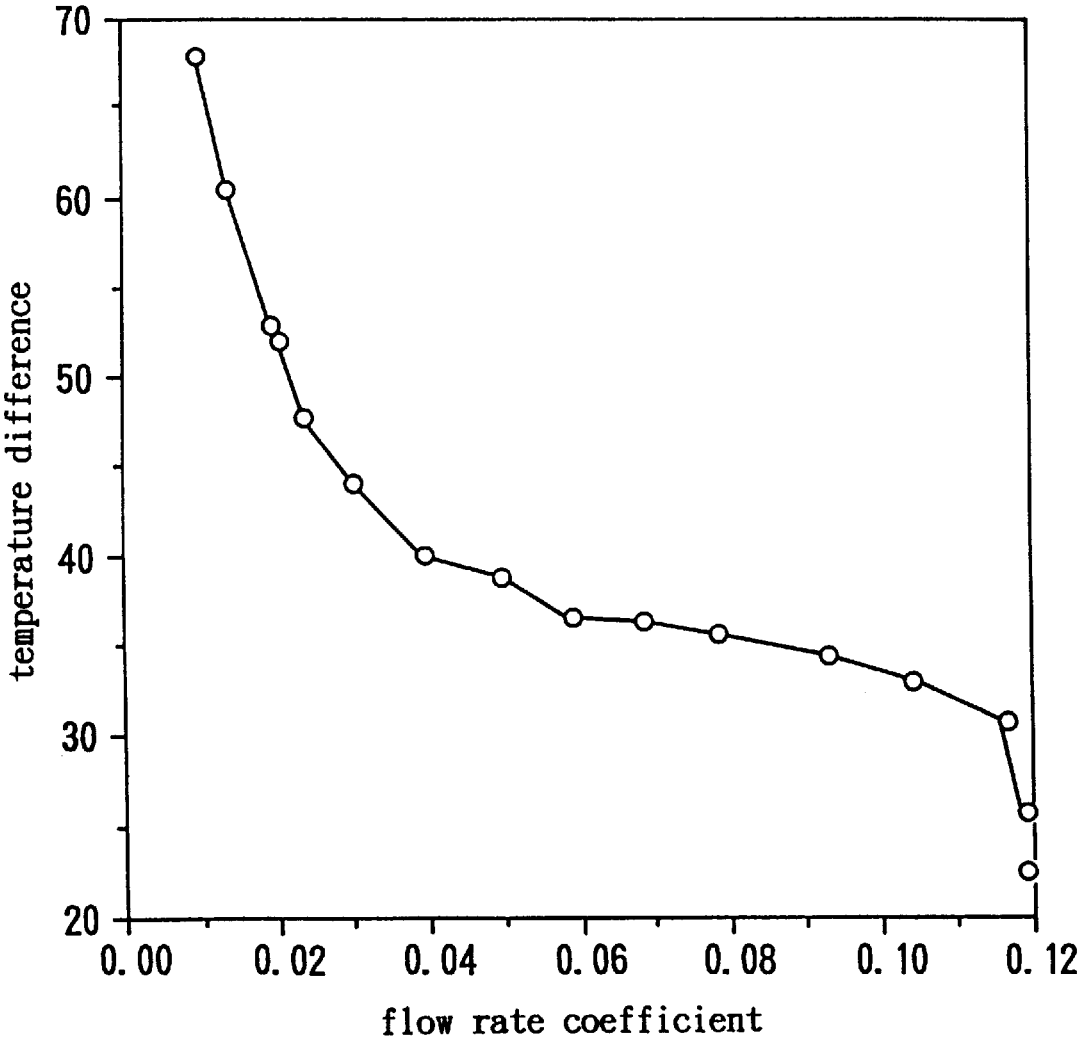
FIG. 28 is a graph showing a relationship between the temperature difference at compressor inlet and exit locations and the flow coefficient.
Figure 29:
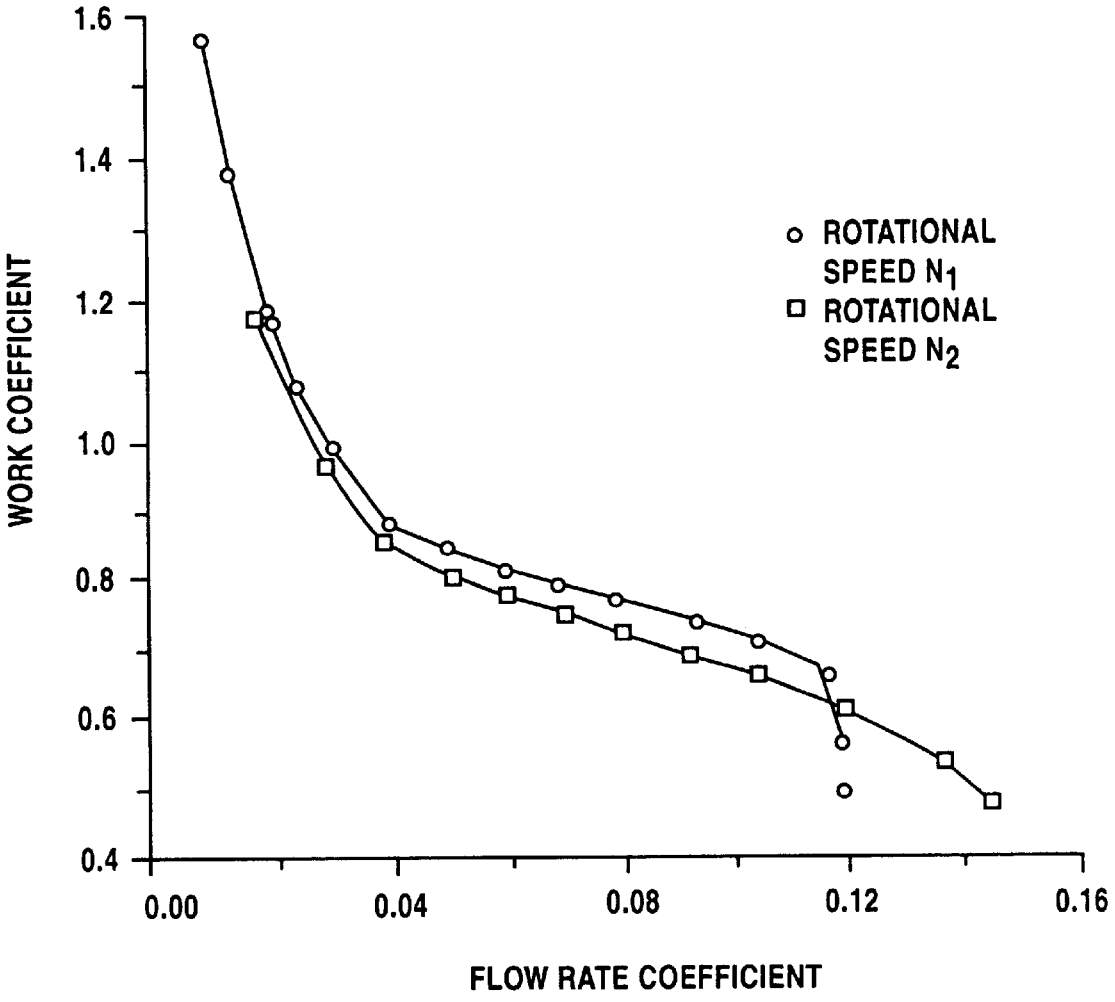
FIG. 29 is a graph showing the work coefficient and the flow coefficient.

For compressors, the difference between the inlet and exit temperatures can vary depending on the operating conditions. FIG. 28 shows that there is some correlation between the temperature difference and the flow coefficient. For compressors, the temperature difference can provide work coefficient (refer to FIG. 29), but the flow rate also shows similar behavior, and therefore, measuring such a parameter can provide data on the inlet flow rate. The results shown in FIG. 28 were obtained under two different rotational velocities N1, N2.

(7) Temperature Difference in Gas Cooling Water

When the heat generated in the compressor is cooled by a gas cooler, the quantity of heat exchanged is given by:

$$L=(T1-T2) \cdot Cp \cdot W$$

where T1 is the flow temperature at the inlet of the gas cooler; T2 is the flow temperature at the exit of the gas cooler; Cp is the specific heat of the gas; and W is the flow rate. The heat generated by the compressor depends on the inlet flow rate, therefore, by measuring the temperature difference of the cooling medium, it is possible to obtain some data on the inlet flow rate.

(8) Noise Effects

The noise generated in the compressor or flow velocity related Straw-Hull Number can also provide some data on the flow rate.

(9) Valve Opening

The degree of opening of inlet or exit valve of the driven device attached to the compressor is related to the flow rate, therefore, by measuring the opening of valves, it is possible to correlate data to the flow rate.

Figure 30:
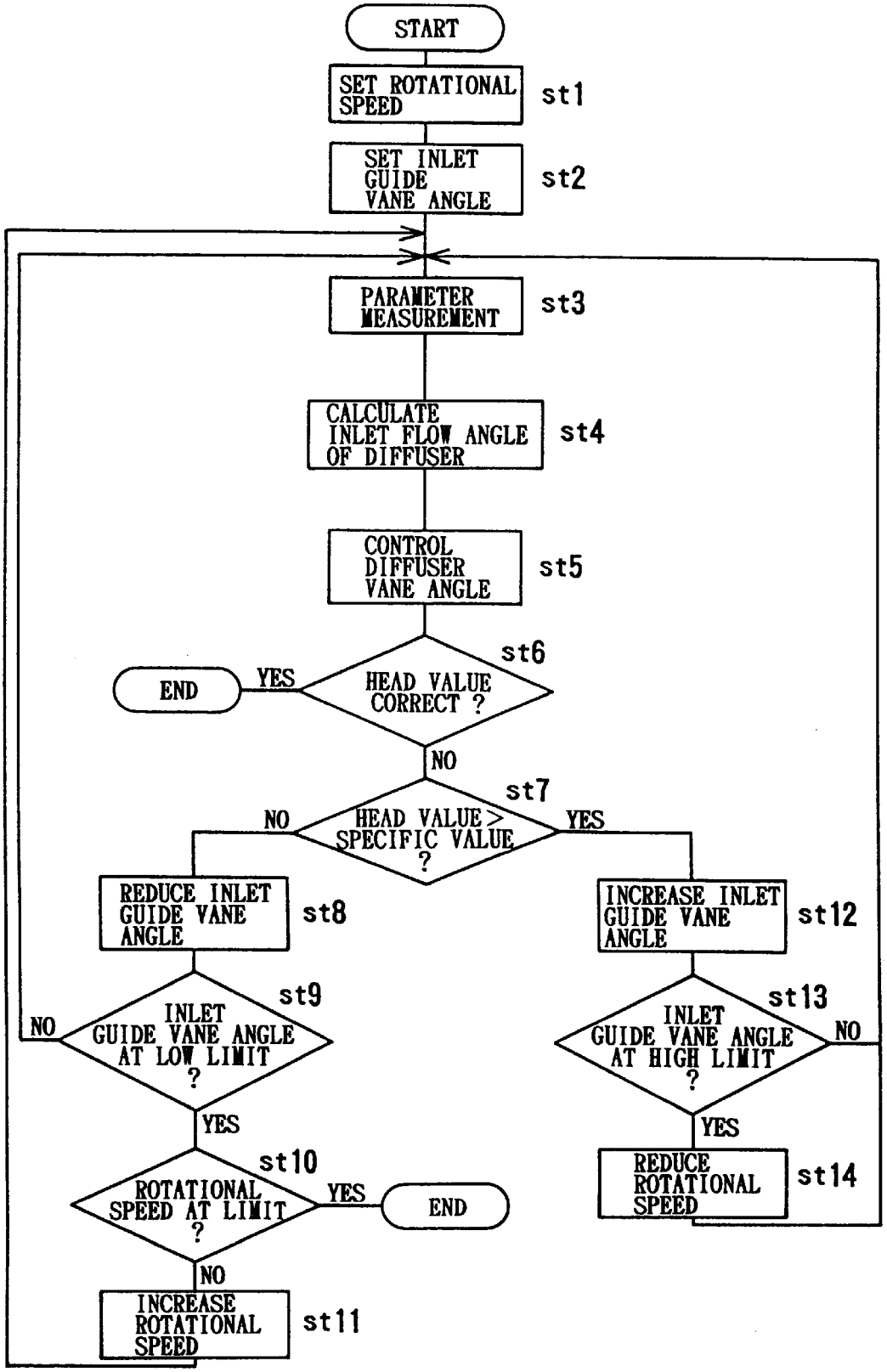
FIG. 30 a flowchart showing the operational steps for the turbomachinery of the present invention having adjustable diffuser vanes.

FIG. 30 shows a flowchart for the operating steps of the embodied turbomachinery having adjustable diffuser vanes. In the following description, "it" refers to CPU 12. In step 1, the rotational speed of the impeller 2 is selected so as not to exceed a specific velocity. In step 2, a suitable vane angle α for the inlet guide vanes 6 is determined from such parameters as a rotational speed N of the impeller 2, a flow rate Q required and a head value H. In step 3, the operating parameters are measured, and in step 4, the diffuser vane angle is determined from the equations presented earlier. In step 5, the inlet guide vane angles are controlled by operating the controller and actuators. In step 6, it is examined whether the head value H is appropriate, and if it is acceptable, then the operation is continued. However, if the head value H is not acceptable, then in step 7, it is examined whether head value H is too large or too small compared with a specified value. If the head value is too small, the angle of the inlet guide vanes 6 is adjusted in step 8.

Next, in step 9, it is examined whether the inlet guide vane angle is at the lower limit. If the decision is NO, it returns to step 3 to repeat the subsequent steps. If the decision is YES, in step 10, the rotational speed is examined to decide if it is at the limit, and if the decision is YES, the operation is continued. If the decision is NO, then in step 11, the rotational speed is increased by a pre-determined amount, and it returns to step 3 to repeat the subsequent steps.

If, in step 7, the head value H is larger than a specified value, then the angle of the inlet guide vanes is increased in step 12. Next, in step 13, it is examined whether the angle of the inlet guide vanes is at the limit, and if the decision is NO, it returns to step 3 to repeat the subsequent steps. If the decision is YES, the rotational speed is reduced in step 14 by a pre-determined amount, and it returns to step 3 to repeat the subsequent steps.

What is claimed is:

1. A turbomachine having diffuser vanes, comprising:

detection means for determining an inlet flow rate of said turbomachine;

detection means for determining a ratio of an inlet pressure to an exit pressure of said turbomachine; and control means for controlling a size of an opening formed by adjacent diffuser vanes on a basis of said inlet flow rate and said pressure ratio determined by said detection means in accordance with a pre-determined relation between said inlet flow rate, said pressure ratio and said size of the opening formed by adjacent diffuser vanes.

2. A turbomachine having diffuser vanes, comprising:

flow detection means for determining an inlet flow rate of said turbomachine; and control means for controlling an angle of said diffuser vanes on a basis of said inlet flow rate in accordance with an equation:

$$\alpha = arctan\ (Q/(K_1N - K_2Q))$$

where $\alpha$ is the angle of the diffuser vanes; Q is the inlet flow rate; N is a rotational speed of an impeller of said turbomachine; and $K_1$ and $K_2$ are constants respectively given by:

$$K_1 = (\pi D_2)^2 \sigma b_2 B$$

$$K_2 = \cot\beta_2$$

where $D_2$ is the exit diameter of the impeller; $\sigma$ is a slip factor; $b_2$ is the exit width of the impeller, B is a blockage factor; and $\beta_2$ is the blade exit angle of the impeller measured from a tangential direction of the inlet radius of the impeller.

3. A turbomachine as claimed in claim 1, wherein said blockage factor is given as a function of the inlet flow rate.

4. A turbomachine as claimed in claim 5, wherein said blockage factor is a linear function of the inlet flow rate.

5. A turbomachine having diffuser vanes, comprising:

detection means for determining an inlet flow rate and rotational speed of said turbomachine; and control means for controlling an angle of said diffuser vanes on a basis of said inlet flow rate, said rotational speed determined by said detection means in accordance with an equation:

$$\alpha = arctan\ (Q/(K_1N - K_2Q))$$

where $\alpha$ is the angle of the diffuser vanes; Q is the inlet flow rate; N is the rotational speed of an impeller of said turbomachine; and $K_1$ and $K_2$ are constants respectively given by:

$$[K = (\pi D2)^2 \sigma b_2/B]K1 = (\pi D_2)^2 \sigma b_2 B$$

$$K2 = \cot\beta_2$$

where $D_2$ is the exit diameter of the impeller; $\sigma$ is a slip factor; $b_2$ is the exit width of the impeller of said turbomachine, B is a blockage factor; and $\beta_2$ is the blade exit angle of the impeller measured from a tangential direction of the inlet radius of the impeller.

6. A turbomachine having diffuser vanes, comprising:

first detection means for determining an inlet flow rate;

second detection means for determining a pressure ratio of an inlet pressure to an exit pressure of said turbomachine; and control means for controlling an angle of said diffuser vanes on a basis of said inlet flow rate, and said pressure ratio determined by said detection means in accordance with an equation:

$$\alpha = arctan\ ((1/P_r)^{1/k}Q/(K_1N - (1/P_r)^{1/k}K_2Q))$$

where $\alpha$ is the angle of said diffuser vanes; Q is the inlet flow rate; $P_r$ is the ratio of the pressures at inlet and exit locations of said turbomachine; N is the rotational speed per minute of an impeller of said turbomachine; $\kappa$ is the specific heat of a fluid; and $K_1$ and $K_2$ are constants respectively expressed as:

$$K1 = (\pi D_2)^2 \sigma b_2 B,\ and$$

$$K_2 = \cot\beta_2$$

where $\sigma$ is a slip factor; $\beta_2$ is the blade exit angle of the impeller measured from a tangential direction of the inlet radius of the impeller, $D_2$ is the exit diameter of said impeller, $b_2$ is the exit width of said impeller, and B is a blockage factor.

7. A turbomachine having diffuser vanes, comprising:

first detection means for determining an inlet flow rate;

second detection means for determining a rotational speed and a pressure ratio of an inlet pressure to an exit pressure of said turbomachine; and control means for controlling an angle of said diffuser vanes on a basis of said inlet flow rate, said rotational speed and said pressure ratio determined by said detection means in accordance with an equation:

$$\alpha = arctan\ ((1/P_r)^{1/k}Q/(K_1N - (1/P_r)^{1/k}K_2Q))$$

where $\alpha$ is the angle of said diffuser vanes; Q is said inlet flow rate; $P_r$ is the ratio of the pressures at inlet and exit locations of said turbomachine; N is the rotational speed per minute of an impeller of the turbomachine; $\kappa$ is the specific heat of a fluid; and $K_1$ and $K_2$ are constants respectively expressed as:

$$K_1 = (\pi D_2)^2 \sigma b_2 B,\ and$$

$$K_2 = \cot\beta_2$$

where $\beta$ is a slip factor; $\beta$ is the blade exit angle of the impeller measured from a tangential direction of the inlet radius of the impeller, $D_2$ is the exit diameter of said impeller, $b_2$ is the exit width of said impeller, and B is a blockage factor.

8. A turbomachine having diffuser vanes, comprising:

detection means for determining an inlet flow rate of said turbomachine: and control means for controlling a size of an opening formed by adjacent diffuser vanes in accordance with the following equation:

$$A = K_4Q/(K_3(K_5N^2 - K_6NQ + K_7Q^2)^{1/2}),$$

wherein A is the size of the opening formed by adjacent diffuser vanes: Q is said inlet flow rate determined by said detection means; N is a constant rotational speed of said turbomachine; and $$K_4 = \pi D_2 b_2 B$$

$$K_5 = (K_4 \sigma \pi D_2)^2$$

$$K_6 = 2K_4 \sigma \pi D_2 \cot\beta_2$$

$$K_7 = 1 + \cot^2\beta_2$$

where $D_2$ is the exit diameter of the impeller; $\sigma$ is a slip factor; $b_2$ is an exit width of the impeller, B is a blockage factor; and $\beta_2$ is a blade exit angle of the impeller.

9. A turbomachine having diffuser vanes, comprising:

detection means for determining an inlet flow rate flowing into said turbomachine and a rotational speed of said turbomachine;

detection means for determining a ratio of an inlet pressure to an exit pressure of said turbomachine; and control means for providing a simultaneous control over an angle of said diffuser vanes and a size of an opening formed by adjacent diffuser vanes on a basis of said inlet flow rate, said pressure ratio determined by said detection means and said rotational speed of said turbomachine determined by said detection means in accordance with the following equation:

$$A = K_4Q_2(K_3(K_5N^2 - K_6NQ_2 + K_7Q_2^2)^{1/2}),$$

where A is the size of the opening formed by adjacent diffuser vanes; Q is said inlet flow rate determined by said detection means: N is said rotational speed of said turbomachine determined by said detection means, and $$K_4=\pi D_2 b_2 B$$

$$K_5=(K_4\sigma\pi D_2)^2$$

$$K_6=2K_4\sigma\pi D_2\cot\beta_2$$

$$K_7=1+\cot^2\beta_2$$

$$Q_2=(1/P_r)^{1/k}Q$$

where $D_2$ is the exit diameter of the impeller; $\sigma$ is a slip factor; $b_2$ is an exit width of the impeller, B is a blockage factor; and $\beta_2$ is a blade exit angle of the impeller; $P_r$ is a ratio of the inlet/exit pressures; and $\kappa$ is the specific heat ratio.

10. A turbomachine as claimed in any one of claims 1 to 9, wherein said control means provide control over a flow rate in a range from a maximum flow rate to a shutoff flow rate.

11. A turbomachine as claimed in any one of claims 1 to 9, wherein said detection means for determining an inlet flow rate determines a value for said inlet flow rate on a basis of operating parameters associated with either said turbomachine or a driving source for said turbomachine.

12. A turbomachine as claimed in one of claims 2 to 7, wherein said blockage factor is given as a function of the inlet flow rate.

* * * * *